US007065838B2

(12) United States Patent
Mitchell et al.

(10) Patent No.: US 7,065,838 B2
(45) Date of Patent: Jun. 27, 2006

(54) LOCKING, SEGMENTED CLEANING IMPLEMENT HANDLE

(75) Inventors: Michael Mitchell, Pleasanton, CA (US); Russell Bell, Pleasanton, CA (US); Cherie A. Bulala, Pleasanton, CA (US); Amy Y. Crandall, Pleasanton, CA (US); German R. Gonzalez, Pleasanton, CA (US); Marcus Wang, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 0 days.

(21) Appl. No.: 10/850,213

(22) Filed: May 19, 2004

(65) Prior Publication Data

US 2005/0257345 A1 Nov. 24, 2005

(51) Int. Cl.
*A45C 3/00* (2006.01)

(52) U.S. Cl. ..... 16/436; 16/429; 16/406

(58) Field of Classification Search ..... 16/436, 16/429, 406, 441; 15/144.3, 145; 248/158, 248/159; 403/319, 329, 109.2, 109.8, 299, 403/307, 315; 81/177.2
See application file for complete search history.

(56) References Cited

U.S. PATENT DOCUMENTS 5,161,278 A * 11/1992 Tomm ..... 15/159.1
5,172,447 A * 12/1992 Tomm ..... 15/159.1
5,924,816 A * 7/1999 Schuele ..... 403/371
6,663,309 B1 * 12/2003 Zamansky et al. ..... 401/264
6,701,578 B1 * 3/2004 Lu ..... 16/429
6,779,235 B1 * 8/2004 Newman et al. ..... 16/427
6,820,301 B1 * 11/2004 Petner ..... 15/145
6,865,776 B1 * 3/2005 Spinelli ..... 16/110.1
2002/0129466 A1 * 9/2002 Thomas ..... 16/436
2003/0001387 A1 1/2003 Tawara et al. ..... 285/328
2003/0009839 A1 1/2003 Streutker et al. ..... 15/228
2003/0084544 A1 * 5/2003 Newman et al. ..... 16/427

FOREIGN PATENT DOCUMENTS

| | | |
|---|---|---|
| WO | WO 01/45546 | 6/2001 |
| WO | WO 01/54867 | 8/2001 |
| WO | WO 02/11601 | 2/2002 |
| WO | WO 03/000108 | 1/2003 |
| WO | WO 03/024295 | 3/2003 |

* cited by examiner

*Primary Examiner*—Chuck Y. Mah
*Assistant Examiner*—Mark T. Vogelbacker

(57) ABSTRACT

Provided is a locking segmented handle for use with a cleaning implement and the like. The handle includes two or more segments that are coupled at assembly to form the handle. Each segment includes connector elements at connector ends of the segments. The connector elements of each segment include components that cooperate with corresponding components of the connector elements of other segments to preclude relative rotational motion of the segments after complete assembly of the segments to form the handle.

26 Claims, 16 Drawing Sheets

LOCKING, SEGMENTED CLEANING IMPLEMENT HANDLE

BACKGROUND OF THE INVENTION

1. Field of the Invention

The present invention generally relates to cleaning implements. More particularly, the present invention relates to cleaning implements that include a cleaning head coupled to a segmented handle that locks against disassembly after complete assembly of the handle segments.

2. Description of the Related Art

Cleaning implements that include a cleaning head and a handle have been available for some time. For example, traditional wet mops consisted of a handle and mop head, where the mop head is moistened with cleaning composition and then used to scrub hard surfaces, such as wood floors. Carpet sweepers have equally been available for some time. Carpet sweepers generally consist of a handle and sweeper mop head that uses the sweeping action to brush carpet soils into the sweeper head for later collection and disposal.

Lately new cleaning implements have been developed that may be used for dry or wet cleaning or both of hard surfaces. These implements consists of a head in the generally in the form of a flat plate to which a sheet or pad is attached. The sheet or pad may be dry, wet or wettable depending on the system or the desired use. An example of such an implement which is useful for wet or dry cleaning is Readimop® produced by The Clorox Corporation.

The most recent trend has been for these wet or dry cleaning implements to be made available to the consumer with segmented handles that are designed to be assembled by the user to form the handle. Providing the cleaning implement in this way permits the implement to be sold in a store shelf sized box. This provides two advantages, the first being relevant to the cost of packing and transporting the mops and the second being relevant to the convenience of the consumer in transporting the mop to their home.

The most common mechanism for assembling the handle segments is by screwing one segment into another. Another common mechanism for assembling the handle is to taper one end of each segment. The tapered end of one segment is then pushed into a non-tapered end of another segment. Both of these mechanisms, however, result in handles that are easily loosened or disassembled. For example catching the mop head on a table leg and pulling will provide enough force to pull tapered handle segments apart. Screw together mechanisms may also easily loosen during use thereby weakening the handle at its segment connector.

Further, many current handles are ergonomically designed, relying on a specific handle shape configured to provide efficient and effective gripping of the cleaning implement to avoid fatigue and strain during use. Handle segments that loosen and do not maintain a specific ergonomic shape are less effective in use with ergonomically designed implements.

Thus, while there is a desire to provide cleaning implements that are convenient and adept at soil removal, there is a further need to provide these cleaning implement in a form which is both easy to ship and easy to assemble by a consumer. Still further, there is a desire to provide cleaning implements that facilitate proper assembly by a consumer and that are ergonomic and easy to use. Accordingly, there is currently a need for improved connector structures for coupling segments making up a segmented cleaning implement handle.

SUMMARY OF THE INVENTION

In accordance with the principles of the present invention, provided is a locking segmented handle, that includes two or more handle segments, that lock to prevent disassembly of the handle segments once completely assembled. The locking segmented handle of the present invention, assures that handle segments will not loosen during use, thus providing a sturdy handle after the handle segment are completely assembled. Further, the locking segmented handle of the present invention may be used with an ergonomically designed cleaning tool. By providing a segmented handle that locks once completely assembled, relative rotational motion of the handle segments is prevented and, thus, the present invention assures that the ergonomically designed shape of the implement handle is maintained during tool use.

The locking segmented handle, sometimes herein simply referred to as the handle, provides a gripping surface for grasping and holding a cleaning implement and a head end surface for attaching a cleaning head to the handle. In one embodiment, the handle includes two segments, namely, a lower segment and an upper segment, each generally of tubular, pipe-like shape having inner and outer cylindrical surfaces. The handle further includes a locking handle connector structure that includes cooperating components on surfaces adjacent connector ends of the lower and upper segments.

More particularly, the lower segment includes a head end having a head end surface for coupling a cleaning head adjacent the head end of the lower segment. The lower segment further includes a lower segment connector element at a lower segment connector surface adjacent a lower segment connector end opposite the head end of the lower segment. The lower segment connector element makes up a part of the handle connector structure that lockably couples the lower and upper segments of the handle after complete assembly of the segments. Finally, the lower segment further includes a lower segment screw member, for example a female screw member, at the lower segment connector surface adjacent the lower segment connector end.

The upper segment includes a gripper end, having a gripper surface for manually grasping a cleaning implement adjacent the gripper end of the upper segment. The upper segment further includes an upper segment connector element at an upper segment connector surface adjacent an upper segment connector end opposite the gripper end of the upper segment. The upper segment connector element forms another part of a handle connector structure that lockably couples the lower and upper segments of the handle after complete assembly of the segments. Finally, the upper segment further includes an upper segment screw member, for example, a male screw member, at the upper segment connector surface adjacent the upper segment connector end.

The male screw member of the upper segment and female screw member of the lower segment are threadibly engageable, which allows the start of initial assembly of the lower and upper segments of the handle. In addition, the components of the lower segment connector element are configured to cooperate with corresponding components of the upper segment connector element to form a handle connector structure that locks the lower and upper segments against either further threadible engagement or reverse threadible disengagement after assembly of the handle segments is completed.

In one embodiment, the lower segment connector element includes a lower segment landing component, configured as a rigid cog, and a bottoming plate, each coupled to the same lower segment connector surface of the lower segment that includes the lower segment screw member. The upper segment connector element includes an upper segment flexing component, configured as a flexible tab, and a bottoming periphery at the upper segment connector end, each coupled to the same upper segment connector surface of the upper segment that includes the upper segment screw member.

At the start of handle assembly, the upper and lower segments are axially aligned, contacted at their respective connector ends, and rotated relative to each other in an engaging, i.e., tightening, angular direction about the central longitudinal axis of the handle, to threadibly engage the upper segment screw member of the upper segment with the lower segment screw member of the lower segment. When the upper segment screw member is fully engaged with the lower segment screw member at complete assembly, the bottoming periphery coupled to the upper segment connector surface adjacent the upper segment connector end contacts the bottoming plate coupled to the lower segment connector surface adjacent the lower segment connector end. Abutting contact between the bottoming periphery of the upper segment and the bottoming plate of the lower segment precludes further tightening engagement of the upper segment and lower segment screw members.

Further, in this completely assembled, fully engaged configuration, the cog of the lower segment contacts and cooperates with the tab of the upper segment to lock the lower and upper handle segments and prevent relative rotation in a disengaging, i.e., loosening, angular direction opposite the tightening angular direction.

Thus, after complete assembly, the upper segment and lower segment screw members, and the respective segments to which they are coupled, may be neither further tightened nor loosened. Said another way, when completely assembled at full threaded engagement, all relative rotation of the upper and lower segments about the longitudinal axis of the handle is precluded, and the relative angular positions of the segments about the central longitudinal axis of the handle is fixed. Accordingly, by providing a segmented handle that locks against relative rotational motion after complete assembly, the present invention assures that, during tool use, the handle segments do not loosen and that any ergonomically designed shape of the handle is maintained.

In one embodiment, the locking handle connector structure includes the above-described bottoming plate of the lower segment and the above described bottoming periphery of the upper segment. In this embodiment, the locking handle connector structure further includes a lower segment flexing component, configured as a flexible post, that cooperates with an upper segment landing component, configured as a rigid stop. This alternate set of flexing and landing components cooperates to preclude relative rotational motion of the upper and lower segments in a loosening angular direction as in the cog/tab embodiment described above.

In another embodiment, the lower segment cog and the lower segment post are combined to cooperate with the corresponding upper segment tab and upper segment stop, respectively, to double lock the coupled handle segments against relative rotational motion.

In another embodiment, all of the various landing components and flexing components as described in the above embodiment, are duplicated. The components are circumferentially spaced apart on their respective generally cylindrical surfaces to provide additional capability to preclude, after complete assembly, relative rotational motion of the upper and lower segments. Yet additional circumferentially or axially spaced apart flexing components and corresponding landing components may be added to this embodiment to provide further additional capacity to preclude relative rotational motion of the upper and lower segments after complete assembly.

Thus, in the various embodiments described, after complete assembly, the upper segment and lower segment screw members, and the respective segments to which they are coupled, may be neither further tightened nor loosened. Said another way, at full engagement, all relative rotation of the upper and lower segments about the longitudinal axis of the handle is precluded and the relative angular position of the segments is fixed. Further, after complete assembly the flexing components and corresponding landing components are not accessible to a user. Thus, the handle is permanently locked after complete initial assembly of the segments and is not unlockable by the user. Accordingly, by providing a segmented handle that permanently locks against relative rotational motion after initial assembly, the present invention assures that, during tool use, the handle segments do not loosen and any ergonomically designed shape of the handle is maintained.

BRIEF DESCRIPTION OF THE DRAWINGS

The foregoing aspects and others will be readily appreciated by the skilled artisan from the following description of illustrative embodiments when read in conjunction with the accompanying drawings, wherein:

FIG. 1C is an exploded perspective view of locking segmented handle 100;

Reference will now be made to the drawings wherein like numerals refer to like parts throughout.

DETAILED DESCRIPTION

In accordance with the principles of the present invention, provided is a segmented handle that locks against disassembly and relative rotational movement of handle segments after a complete initial assembly. The locking segmented handle of the present invention may be used with a tool such as an ergonomically designed cleaning implement.

In one embodiment, the handle includes two or more handle segments, each generally of a tubular pipe-like shape and coupled, end to end, in the longitudinal axial direction of the handle. The handle further includes a handle connector structure that includes components on surfaces adjacent connector ends of the two or more handle segments.

Figure 1A:
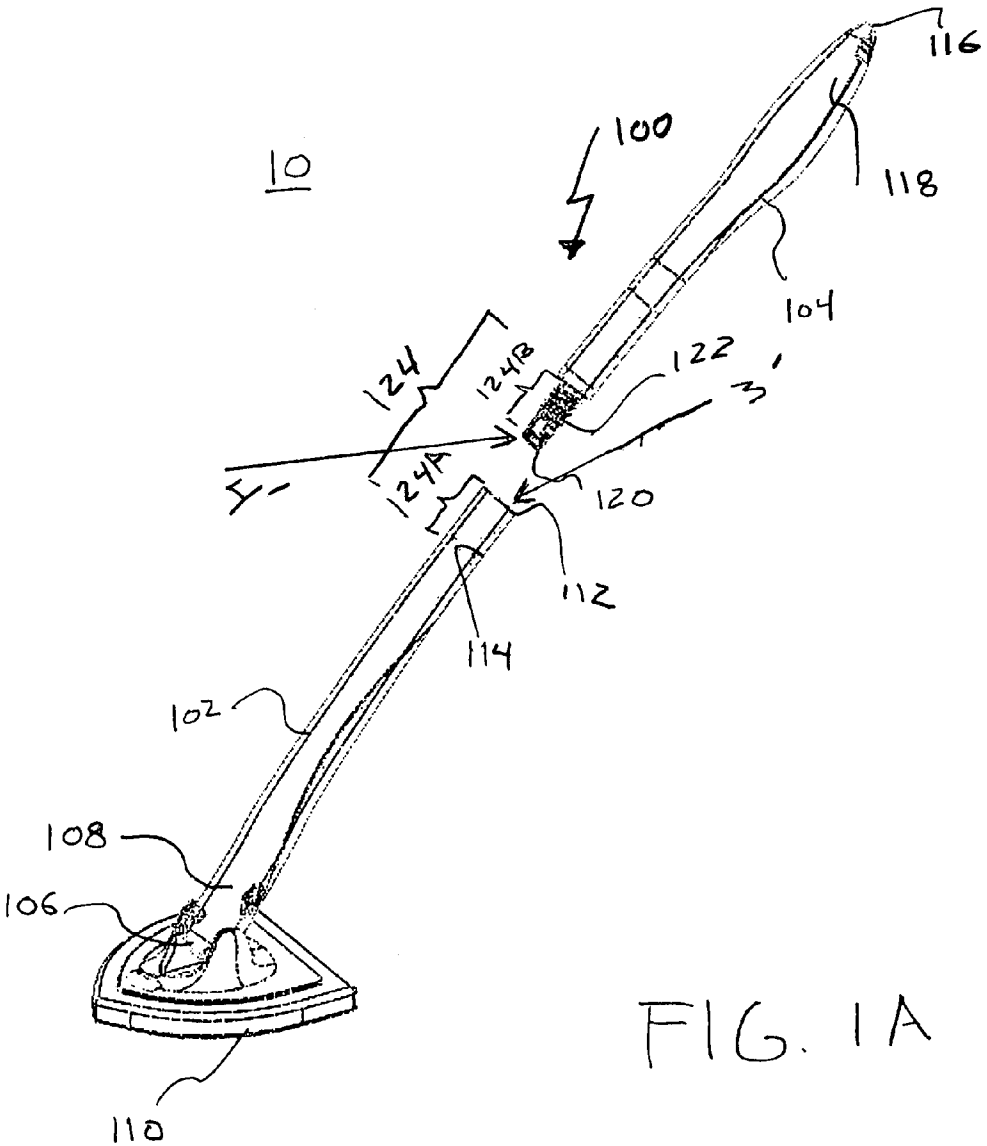
FIG. 1A is a perspective view, before assembly, of a cleaning implement 10, having a locking segmented handle 100 in accordance with one embodiment of the present invention.
Figure 1B:
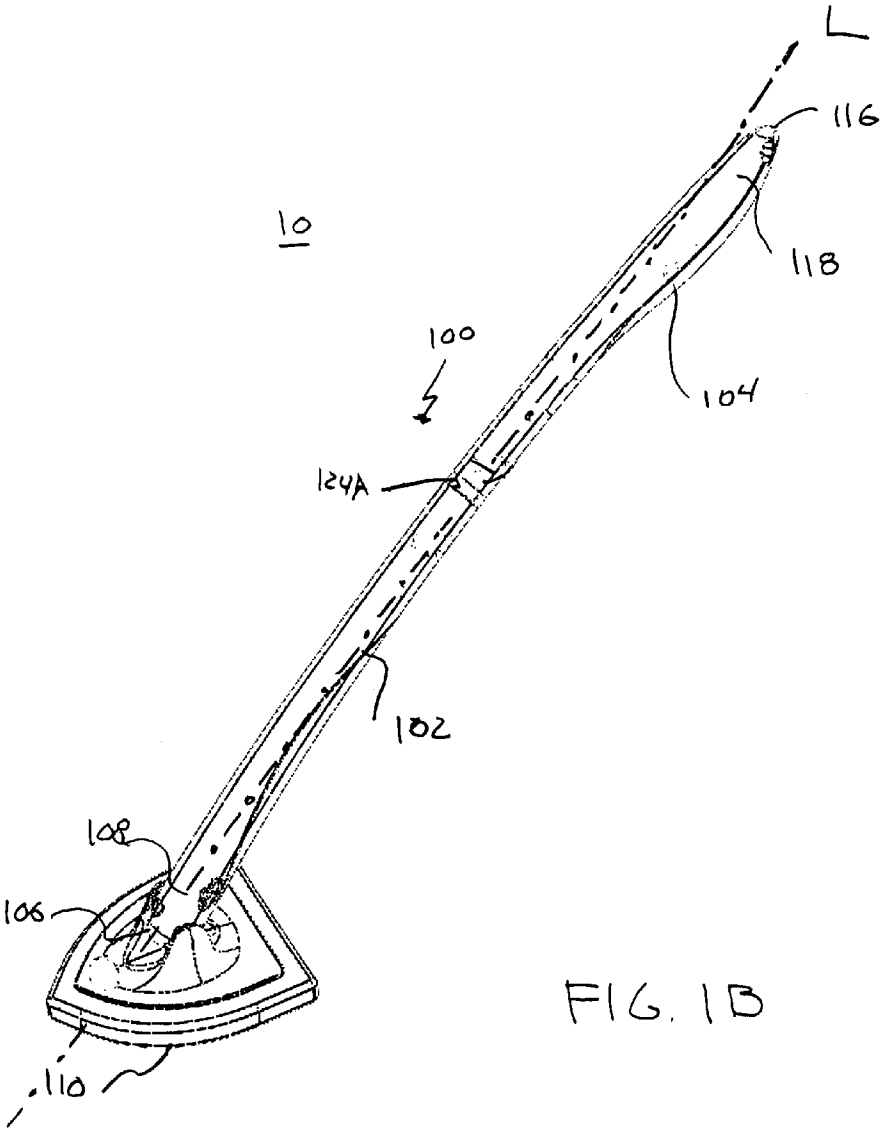
FIG. 1B is a perspective view of the locking segmented handle of FIG. 1A, after assembly.
Figure 16:
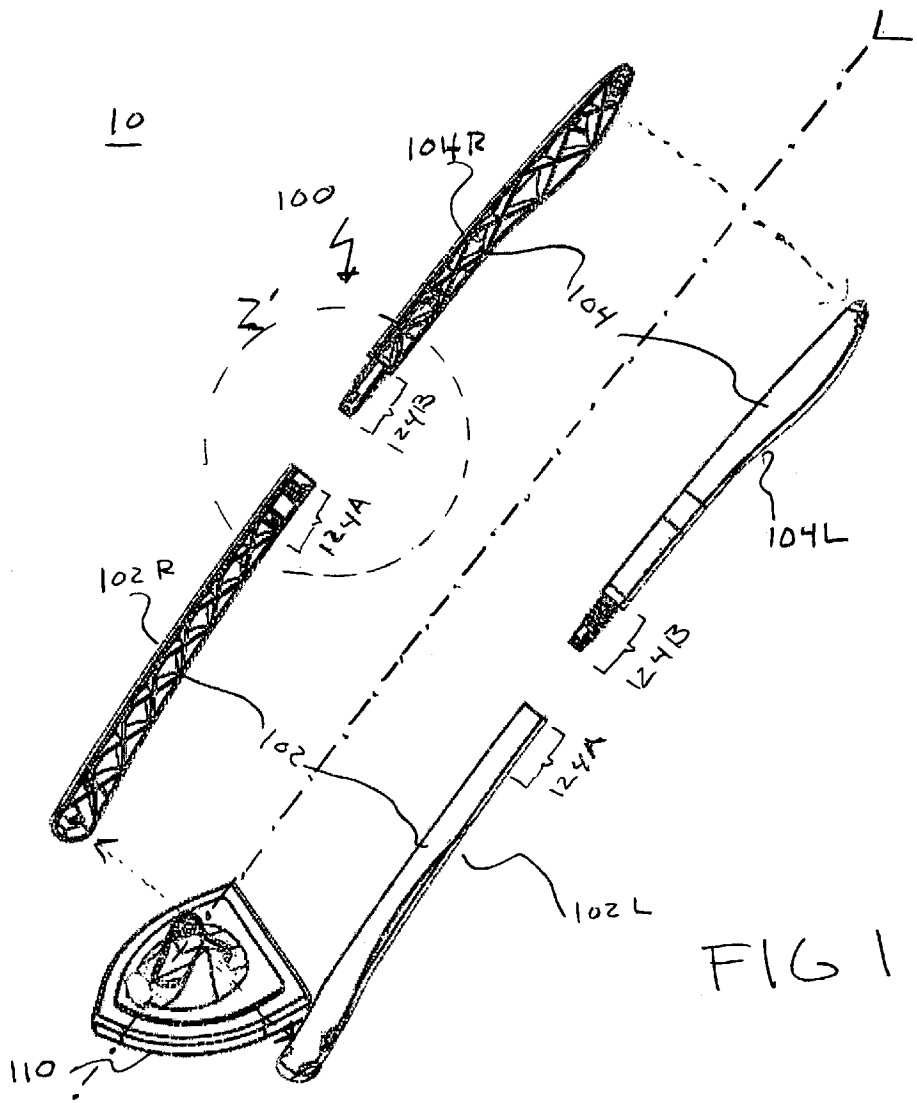

More particularly, FIG. 1A is a perspective view, before assembly, of a cleaning implement 10, having a locking segmented handle 100 in accordance with one embodiment of the present invention. FIG. 1B is a perspective view of segmented handle 100 of FIG. 1A, after assembly. Referring to FIGS. 1A and 1B together, handle 100 includes a lower, e.g., first, segment 102 and an upper, e.g., second, segment 104, each generally of a tubular, pipe-like shape having inner and outer cylindrical surfaces. In another embodiment, lower segment 102 and/or upper segment 104 may be solid or may be shaped other than cylindrically. At initial assembly, lower segment 102 is coupled to upper segment 104 to form handle 100.

The terms "lower" and "upper" are used herein for ease of description and are not meant to indicate that handle segments 102 and 104 must have a specific orientation except as specifically set forth below in regard to the relative orientation of lower handle segment 102 with upper handle segment 104 at assembly of the handle segments. It should be understood that handle 100 can be oriented vertically, horizontally, or at any angle during use with, for example, cleaning implement 10, as required by the particular situation.

Lower segment 102 has a head end 106 and a head end surface 108, i.e., the exterior cylindrical surface of lower segment 102 adjacent head end 106, at which a cleaning head 110 is rotatably attached to lower segment 102. Lower segment 102 also has a lower segment connector end 112 (FIG. 1A) opposite head end 106. At assembly of handle 100, lower segment 102 is coupled with upper segment 104 at a lower segment connector surface 114, i.e., the interior cylindrical surface of lower segment 102 adjacent lower segment connector end 112.

Upper segment 104 has a gripper end 116 and a gripper end surface 118, i.e., the exterior cylindrical surface of upper segment 104 adjacent gripper end 116, for grasping cleaning implement 10 by handle 100. Upper segment 104 also has an upper segment connector end 120 opposite gripper end 116. At assembly, upper segment 104 is coupled with lower segment 102 at an upper segment connector surface 122, i.e., the exterior cylindrical surface of upper segment 104 adjacent upper segment connector end 120.

As described more fully below with reference to FIGS. 2 and 3, components on lower segment connector surface 114 make up a lower segment connector element 124A. Also, as described more fully below with reference to FIGS. 2 and 4, components on upper segment connector surface 122 make up an upper segment connector element 124B. Together lower segment connector element 124A and upper segment connector element 124B make up handle connector structure 124 that couples lower segment 102 and upper segment 104 to form handle 100 and locks upper and lower segments 102 and 104 at complete initial assembly of the segments.

Thus, as shown in FIG. 1B, after assembly, lower segment 102 and upper segment 104 are coupled by handle connector structure 124 along the longitudinal direction of a handle central axis L of handle 100. Advantageously, the individual length of the longer of lower segment 102 and upper segment 104 is necessarily less than the overall length of handle 100 along central axis L after assembly, since lower segment 102 is coupled lengthwise with upper segment 104 to make up handle 100.

Accordingly, cleaning implement 10 may be provided unassembled, in a store shelve sized box, thereby reducing the cost of packing and transporting cleaning implement 10 to the point of sale to the consumer. Additionally, the consumer is provided a more convenient package for transporting cleaning implement 10 before assembly. Further, after assembly, handle connector structure 124 locks lower segment 102 and upper segment 104 against relative rotational movement about central axis L. Locking segmented handle 100, assures that handle segments 102 and 104 will not disengage and loosen during use, which assures that any ergonomically designed shape of handle 100 is maintained.

In one aspect of this embodiment, lower segment 102 and upper segment 104, may each be integrally formed by, for example, plastic gas assisted injection molding. In another aspect, tubular, pipe-like structures may be integrally formed in parts, e.g. left and right separated generally along a plane intersecting the central axes of the tubular structure, such as central axis L of handle 100 by conventional injection molding. The left part and right part of the tubular structure are fixedly joined after manufacture with adhesive, fasteners or the like to form a completed tubular structure. Thus, lower segment 102 and upper segment 104 may be formed in left and right parts. In other embodiments, lower segment 102 and upper segment 104 may be formed in more than two parts.

FIG. 1C is an exploded perspective view of locking segmented handle 100. Referring to FIGS. 1A and 1C together, as described above, lower segment 102 of handle 100 is coupled by handle connector structure 124 along central axis L to upper segment 104 at the initial assembly of handle 100. Also, as shown in FIG. 1C, lower segment 102 is formed in parts, namely lower segment left part 102L and lower segment right part 102R divided at a plane (not shown) passing through central axis L of handle 100. Likewise, upper segment 104 is formed in parts, namely upper segment left part 104L and upper segment right part 102R. After manufacture of the left and right parts of the upper and lower segments, the corresponding left and right parts are fixedly joined before assembly of lower segment 102 and upper segment 104 of handle 100. The terms "left" and "right" are used herein for ease of description and are not meant to indicate that corresponding left and right parts of handle segments 102 and 104 must have a specific orientation except as specifically set forth above in regard to the relative orientation when corresponding right and left parts are fixedly joined after manufacture. It should be understood that handle 100 can be oriented vertically, horizontally, or at any angle during use with, for example, cleaning implement 10, as required by the particular situation.

Handle connector structure 124, which includes lower segment connector element 124A and upper segment connector element 124B, and by which lower segment 102 and upper segment 104 are coupled at assembly, is next described. FIG. 2 is a close-up perspective side view of the circled part of FIG. 1C marked as 2'. For clarity of presentation in FIG. 2, only lower segment right part 102R and upper segment right part 104R of handle 100 are shown, although it is understood that corresponding left parts of lower segment 102 and upper segment 104 are fixedly joined to corresponding right parts prior to initial assembly of lower segment 102 with upper segment 104. FIG. 3 is a close up perspective connector end view of lower segment connector surface 114 of lower segment 104 taken in the direction 3' of FIG. 1A.

Figure 2:
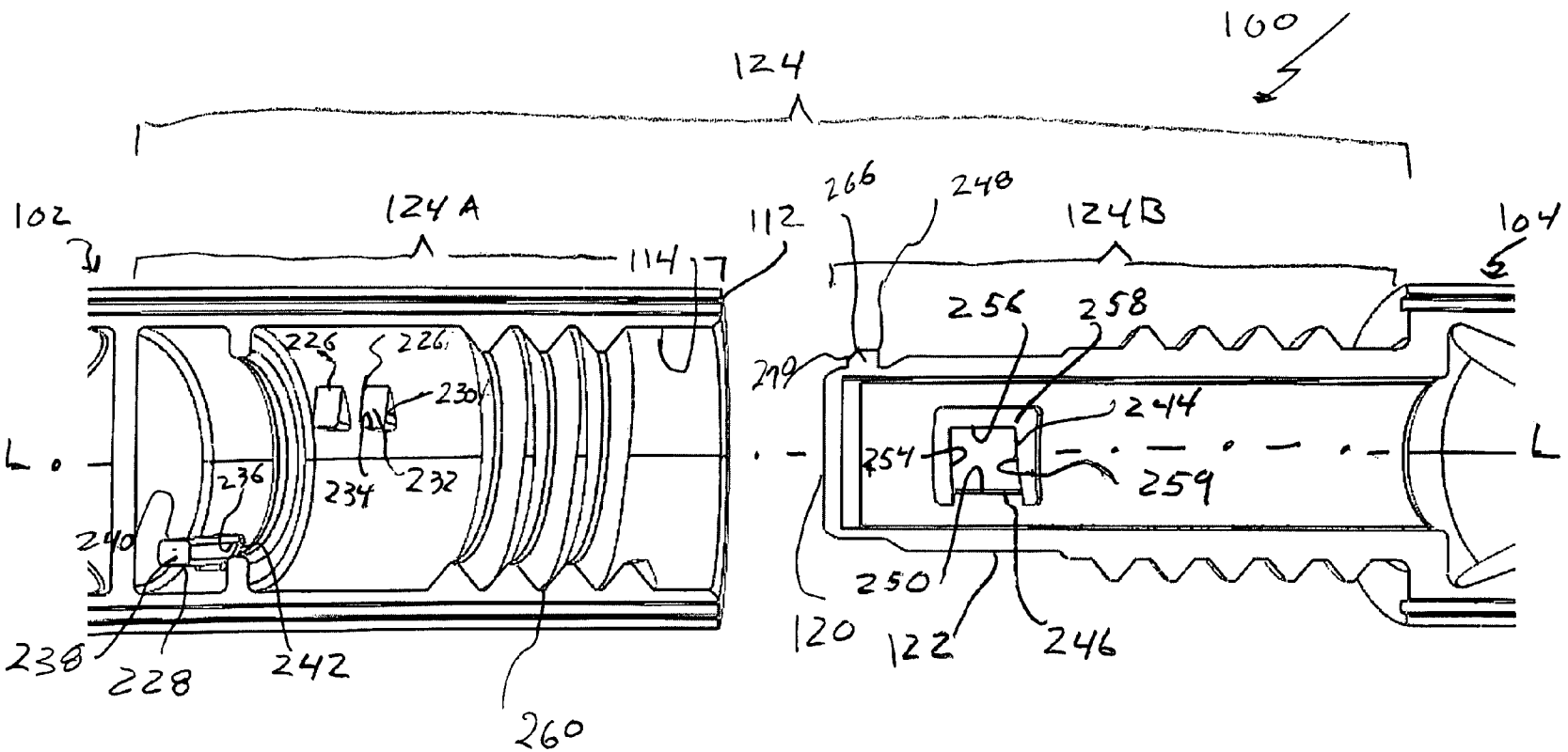
FIG. 2 is a close-up perspective side view of the circled part of FIG. 1C marked as 2'.
Figure 3:
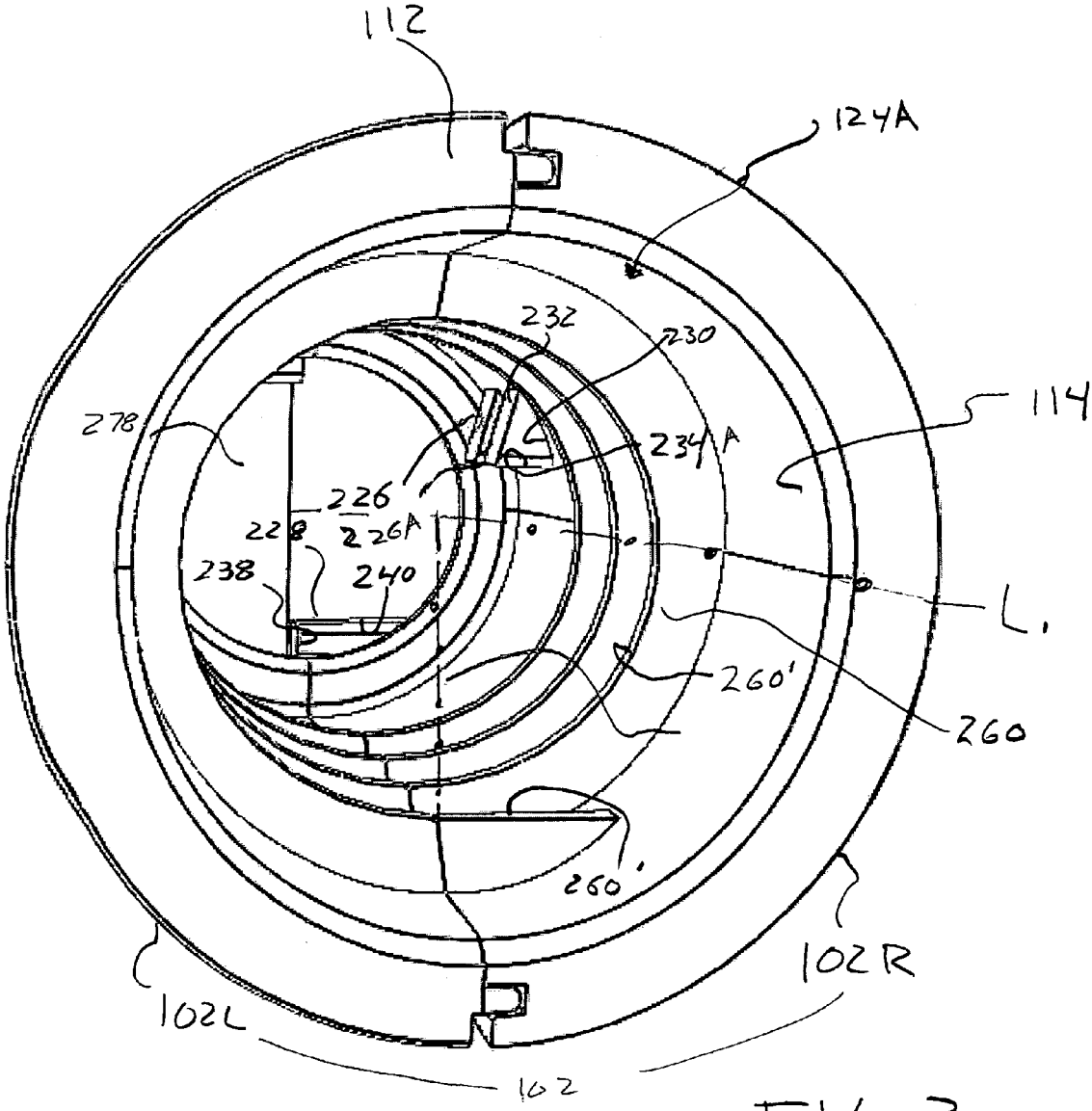
FIG. 3 is a close up perspective connector end view of a lower segment connector surface of the lower segment taken in the direction 3' of FIG. 1A.

Referring to FIGS. 2 and 3 together, handle 100 includes handle connector structure 124 that includes, in part, lower segment connector element 124A. Lower segment connector element 124A of handle connector structure 124 includes components on lower segment connector surface 114 adjacent lower segment connector end 112. Lower segment connector element 124A includes at least one lower segment landing component configured as cog structure 226 rigidly coupled to lower segment connector surface 114 of lower segment 102 and at least one lower segment flexing component configured as post 228 (FIG. 2) flexibly coupled to lower segment connector surface 114.

When it is said herein that a first part is rigidly coupled to a second part, it is meant that, upon application of a force tending to relatively displace the parts, the parts resists the force such that the relative displacement of the parts does not affect the function of the parts in a locking segmented handle. When it is said that a first part is flexibly coupled to a second part, it is meant that, upon application of a force tending to relatively displace the parts, the parts elastically yield to the force such that the relative displacement of the parts is sufficient to allow the parts to perform a function in a locking segmented handle. Further, when the displacing force is removed, the parts elastically return to their original configuration.

More particularly, in the embodiment of lower segment connector element 124A shown in FIGS. 2 and 3, two individual cogs 226, axially spaced apart on lower segment connector surface 114 in the direction of central axis L of handle 100 makes up a lower segment landing component. Illustratively, each cog 226, such as first cog 226, is generally configured as a triangular wedge shaped block that includes a cog coupling face 230, a tab flexing face 232, and a tab locking face 234. Cog coupling face 230 is a surface that generally conforms to, contacts and is rigidly coupled to lower segment connector surface 114 to rigidly couple cog structure 226 to lower segment connector surface 114 of lower segment 102. Tab flexing face 232, and tab locking face 234 of cog structure 226 are each configured generally as flat surfaces. Tab flexing face 232 slopes generally radially inward from lower segment connector surface 114 toward central axis L, while tab locking face 234A makes up the third face of the triangular wedge shape of cog structure 226 intersecting tab flexing face 232 and cog coupling face 230 of cog structure 226. The number of cogs 226 may be one, two, or may be more than two without departing from the principles of the present invention. In these embodiments, all cog structures are generally configured and shaped similarly to cog structure 226. However, it is envisioned that cog structures having different configurations and/or shapes may be used to accomplish the locking features of the present invention. For example, one or more cog structures may be configured as indentations or apertures within the lower segment connector surface 114 of lower segment 102. Yet other examples are described more particularly below with reference to FIGS. 8–10B.

Also, more particularly with respect to the embodiment of lower segment connector element 124A shown in FIGS. 2 and 3, a post 228 generally of a rectangular pillar shape comprises a lower segment flexing component. Post 228 includes a post coupling face 236 (FIG. 2), and a stop locking face 238 at opposite ends of pillar shaped post 228, and a stop contacting face 240.

Stop contacting face 240 of post 228 is the rectangular pillar peripheral surface most proximal central axis L. Post coupling face 236 is a surface that generally conforms to and contacts lower segment connector surface 114. A post hinge 242 (FIG. 2) circumscribes post coupling face 236 at the peripheral edge of post coupling face 236 and flexibly couples post 228 to lower segment connector surface 114. Post hinge 242 is configured to allow post 228 to flexibly deflect about post hinge 242 while remaining coupled to lower segment connector surface 114.

Figure 4:
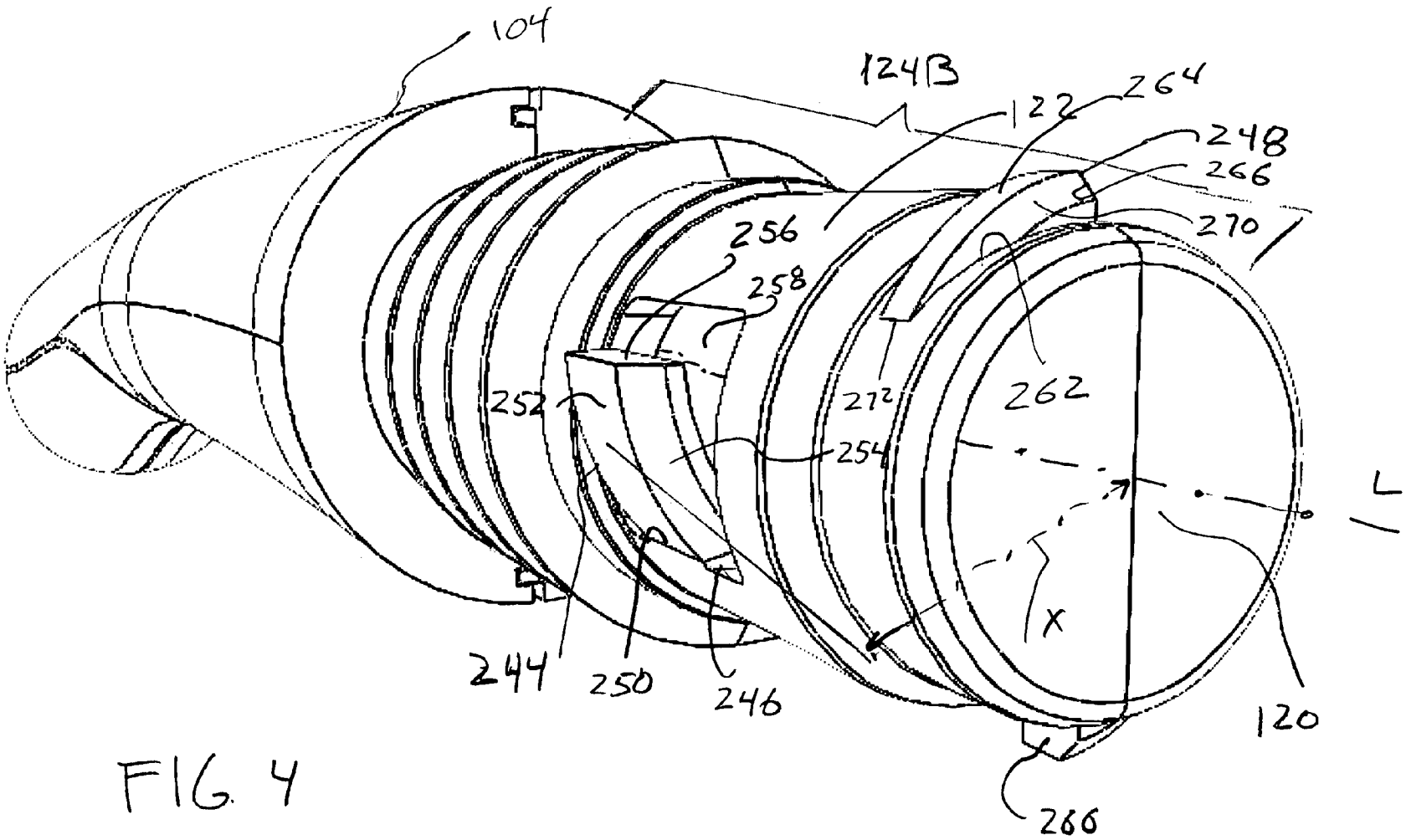
FIG. 4 is a close up perspective connector end view of an upper segment connector surface of the upper segment of FIG. 1A taken in the direction 4'.

Further, upper segment connector element 124B, included as another part of handle connector structure 124, includes components on upper segment connector surface 122 adjacent upper segment connector end 120. FIG. 4 is a close up perspective connector end view of upper segment 104 taken in the direction 4' of FIG. 1A. Referring to FIGS. 2 and 4 together, in one embodiment, upper segment connector element 124B includes an upper segment flexing component configured as a tab 244 flexibly coupled by a tab hinge 246 to and flaring radially outwardly from upper segment connector surface 122. Upper segment connector element 124B further includes an upper segment landing component configured as a stop 248 rigidly coupled to upper segment connector surface 122.

More particularly, in the embodiment of upper segment connector element 124B shown in FIGS. 2 and 4, tab 244 is a rectangular shaped plate, arced in one plane in a radius and direction generally conforming to the outer circumferential tubular curvature of upper segment connector surface 122. Tab 244 includes a tab coupling face 250, a cog contacting face 252 (FIG. 3), a chamfered tab front face 254, a cog locking face 256, and a tab trailing face 259 (FIG. 2) opposite tab front face 254.

Tab coupling face 250 generally conforms to, contacts and is flexibly coupled to upper segment connector surface 122 by tab hinge 246 at a tab slot 258 of upper segment connector surface 122. Tab hinge 246 circumscribes tab coupling face 250 at the peripheral edge of tab coupling face 250 and flexibly couples tab 244 to one edge of tab slot 258. Tab front face 254, cog locking face 256, and tab trailing face 259 (FIG. 2) of tab 244 are free and are not coupled to upper segment connector surface 122 at tab slot 258. Tab hinge 246 is configured to allow tab 244 to flexibly displace inwardly and outwardly with respect to central axis L while remaining coupled to upper segment connector surface 122.

Figure 5A:
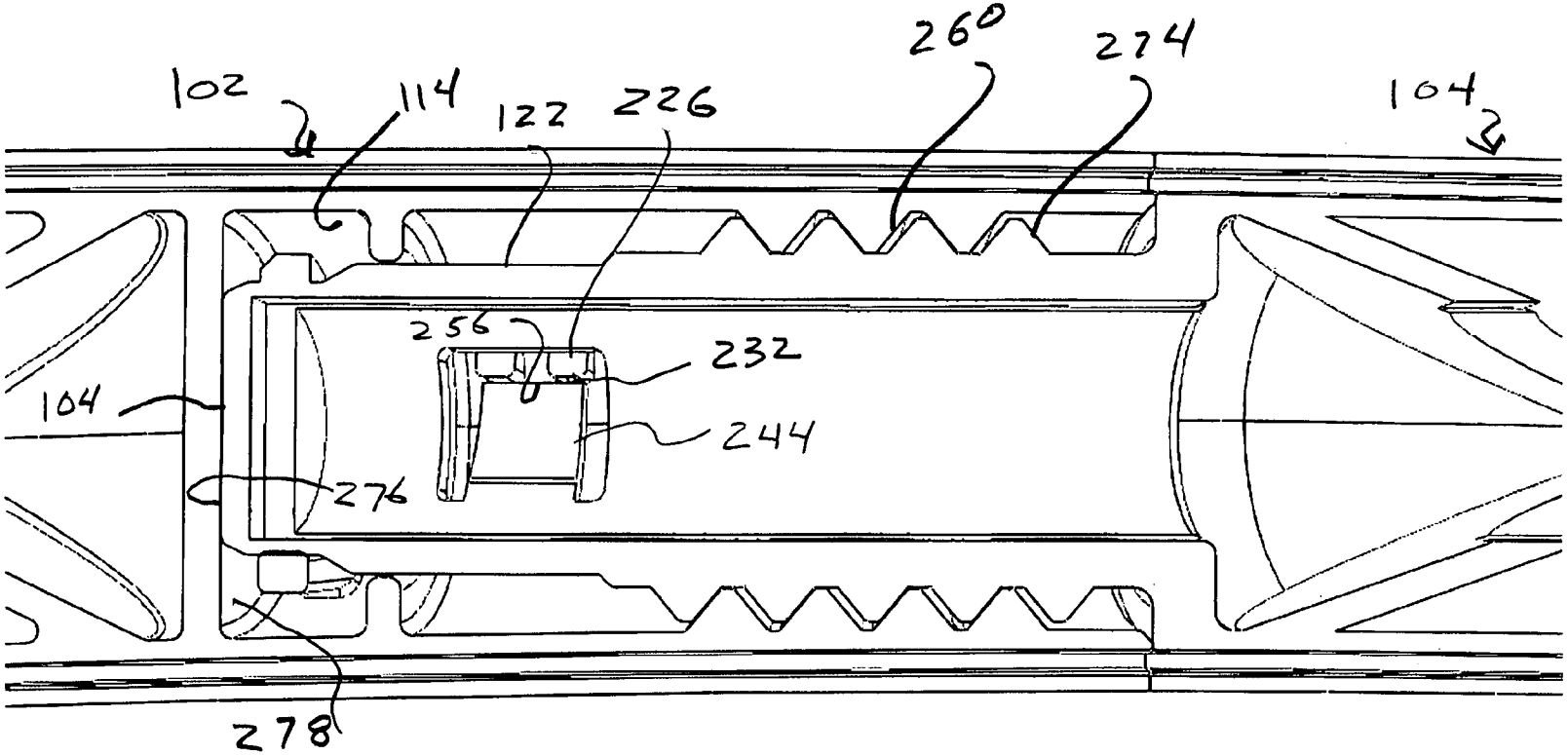
FIG. 5A is a close-up perspective view similar to FIG. 2 showing, after complete assembly, the lower segment connector surface of the lower segment right part and the upper segment connector surface of the upper segment left part.
Figure 5B:
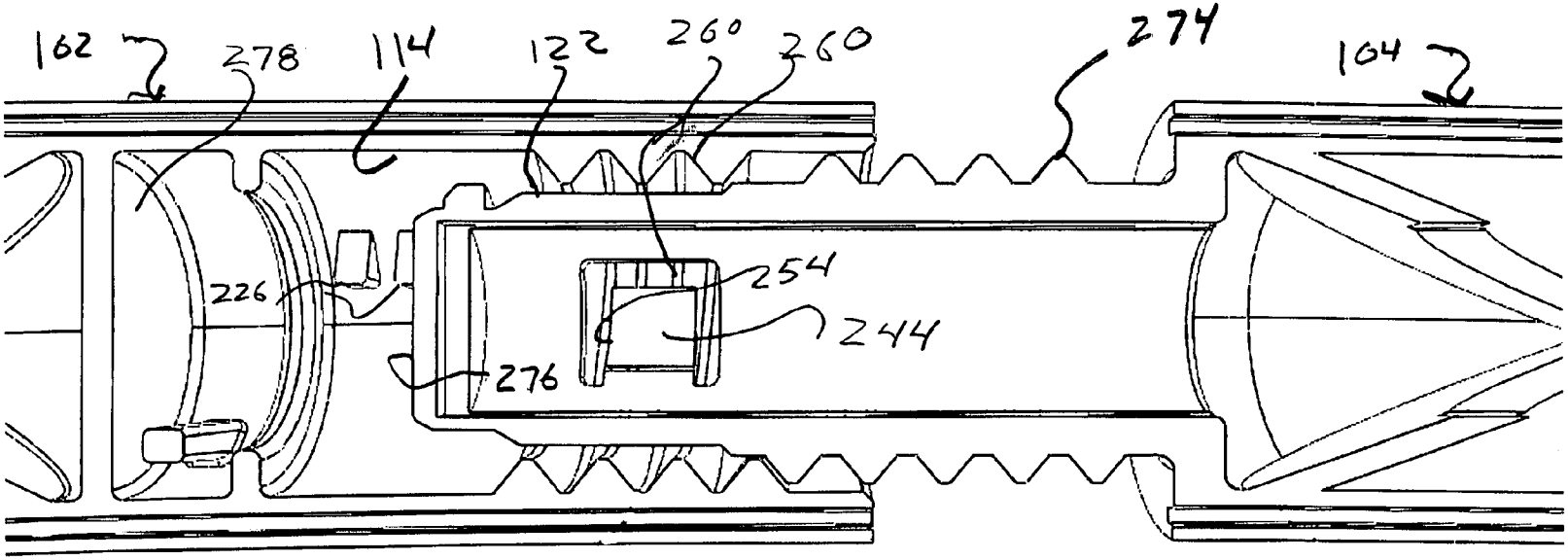
FIG. 5B is a close-up perspective view similar to FIG. 5A showing the lower segment connector surface and the upper segment connector surface at a first point of threaded engagement before the lower segment and the upper segment are completely assembled.
Figure 5C:
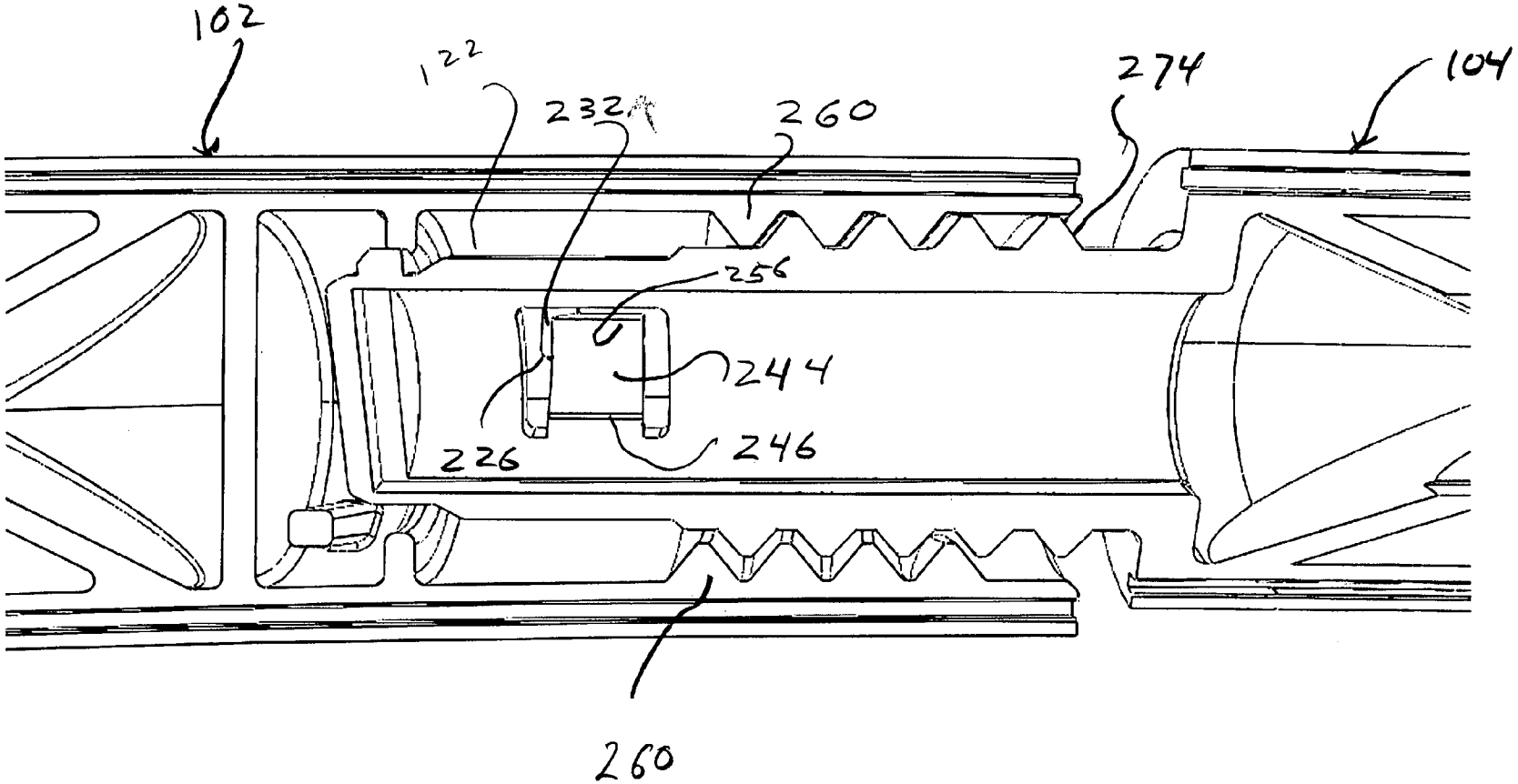
FIG. 5C is a close-up perspective view similar to FIG. 5B at a second point of threaded engagement after the first point of engagement depicted in FIG. 5B but still before the lower segment and the upper segment are completely assembled as shown in FIG. 5A.

Cog contacting face 252 of tab 244 is the tab surface located most distal from central axis L and, as described more fully below with reference to FIGS. 5A and 5C, is configured as an arced surface to cooperated with tab flexing face 232 of cog 226 (FIG. 2) to displace tab 244 inwardly during initial assembly of lower segment 102 and upper segment 104. Tab front face 254 is located most proximal to upper segment connector end 120 and is configured as a chamfered surface backwardly slanting from upper segment connector end 120 toward cog contacting face 252.

As also described more fully below with reference to FIG. 5B, at initial assembly of lower segment 102 and upper segment 104, tab front face 254 cooperates with a lower segment screw member 260, coupled to upper segment connector surface 122, to displace tab 244 inwardly thereby avoiding spacial interference between tab 244 and lower segment screw member 260 during assembly.

Finally, as also described more fully below with reference to FIGS. 5A and 5C, cog locking face 256 of tab 244, located opposite tab coupling face 250, and approximately perpendicular to both tab front face 254 and cog contacting face 252, is configured as a flat surface to cooperate with tab locking face 234 (FIG. 2) of cog 226 to lock lower segment 102 and upper segment 104 and, thus, prevents disengaging relative rotation after lower segment 102 and upper segment 104 are complete assembled.

Also more particularly with respect to the embodiment of upper segment connector element 124B shown in FIG. 4, stop 248 is generally a triangular wedge shaped block that includes a stop coupling face 262, a post flexing face 264, a post locking face 266, and a chamfered stop front face 270.

Stop coupling face 262 is a surface that generally conforms to, contacts and is rigidly coupled to upper segment connector surface 122 to rigidly couple stop 248 to upper segment connector surface 122 of upper segment 104. Post flexing face 264 of stop 248 is configured generally as a sloping curved surface most distal from central axis L. Post flexing face 264 spirals outwardly from central axis L starting from an intersection line 272 between post flexing face 264 and upper segment connector surface 122. Post locking face 266 makes up the third face of the triangular wedge shape of stop 248, and intersects post flexing face 264 and stop coupling face 262 of stop 248. Stop front face 270 of stop 248 is a surface most proximal to upper segment connector end 120, and which spans stop coupling face 262 and post flexing face 264. Stop front face 270 is chamfered backward to post flexing face 264.

As described more fully below with reference to FIGS. 6A and 6B, post flexing face 264 of stop 248 is configured to cooperated with stop contacting face 240 of post 228 (FIGS. 2 and 4) to flexibly displace post 228 outwardly from central axis L at a particular point during assembly of lower segment 102 and upper segment 104. As also described more fully below with reference to FIGS. 6A and 6B, post locking face 266 (FIG. 4) is configured as a flat surface to cooperate with stop locking face 238 of post 228 (FIG. 2) to lock lower segment 102 and upper segment 104 against disengaging relative rotation after complete assembly of the segments.

The cooperation of cog 226 with tab 244 during assembly of upper segment 104 and lower segment 102 of handle 100 is next described. For clarity of presentation, in FIG. 5A, only lower segment right part 102R and upper segment right part 104R of handle 100 are shown, although it is understood that left parts of lower segment 102 and upper segment 104 are fixedly joined to corresponding left parts prior to initial assembly of lower segment 102 with upper segment 104. FIG. 5A is a close-up perspective view similar to FIG. 2 showing, after complete assembly, lower segment connector surface 114 of lower segment right part 102R and upper segment connector surface 122 of upper segment right part 104R.

Also, as shown in the FIGS. 5A–5C, when an upper segment screw member 274, coupled to upper segment connector surface 122, engages lower segment screw member 260 with clockwise rotation of upper segment 104 relative to lower segment 102 when viewed in a direction toward lower segment connector end 112, such as direction 3' of FIG. 1A, handle segments 102 and 104 tightened together. Said another way, upper segment 104 rotates and axially advances within lower segment 102 with clockwise rotation of upper segment 104 relative to lower segment 102. More particularly, (See FIG. 1) upper segment connector element 124B axially advances within lower segment connector element 124A with clockwise rotation of upper segment 104 relative to lower segment 102 in accord with the clockwise helical pitch of screw members 260 and 274. Thus, in this embodiment, the locking cooperation of the components of handle connector structure 124 is described in terms of clockwise rotation of upper segment 104 relative to lower segment 102. It is understood, however, that in other embodiments the threading hand of screw members 260 and 274 may be reversed so long as the hand of the various components included in handle connector structure 124 is likewise reversed.

Referring to FIG. 5A, at the completion of assembly of lower segment 102 and upper segment 104, cog locking face 256 of tab 244 is positioned to engage tab locking face 232 of cog 226 in abutting contact thereby precluding counterclockwise, loosening disengagement of lower segment 102 and upper segment 104. Further, at completion of assembly, upper segment 104 has advanced within lower segment 102 to a point where a bottoming periphery 276 adjacent upper segment connector end 120 contacts a bottoming plate 278, coupled to lower segment connector surface 114, thereby precluding further clockwise tightening engagement of lower segment 102 and upper segment 104.

More particularly, FIG. 5B is a close-up perspective view similar to FIG. 5A showing the right side of lower segment connector surface 114 and upper segment connector surface 122 at a first point of threaded engagement before lower segment 102 and upper segment 104 are completely assembled. Referring to FIGS. 3, 4, and 5B, at this first point of engagement, upper segment 104 has not yet advanced within lower segment 102 to a point where bottoming periphery 276 of upper segment 104 contacts bottoming plate 278 of lower segment 102. Thus, upper segment 104 may be further rotated in a clockwise direction relative to lower segment 104 to advance upper segment 104 within lower segment 102. At the point of advancement shown in FIG. 5B, chamfered tab front face 254 (FIG. 4) of tab 244 has just contacted lower segment screw member 260. In the embodiment shown, tab 244 flares radially outwardly from upper segment connector surface 122 such that the distance x (FIG. 4) from central axis L to cog contacting face 252 of tab 244 exceeds a minimum radius $r_m$ (FIG. 3) of lower segment screw member 260, i.e, from central axis L to a lower segment screw member peak 260' of lower segment screw member 260.

With further clockwise rotation of upper segment 102 beyond this first point, tab 244 is compressed inwardly toward central axis L by abutting contact of lower segment screw member 260 with tab front face 254. The backward chamfer of tab front face 254 directs compression of tab 244 radially inward in a direction toward central axis L allowing cog contacting face 252 (FIG. 4) of tab 244 to ride up on lower segment screw member peak 260' to maintain compression of tab 244. Thus, spacial interference between tab 244 and lower segment screw member 260 during assembly of handle 100 is avoided. With further clockwise rotation, tab 244 axially advances to the point where tab 244 clears lower segment screw member 260, whereby tab hinge 246 elastically returns tab 244 to its original uncompress, radially flared configuration. In another embodiment distance x (FIG. 4) from central axis L to cog contacting face 252 of tab 244 is less than minimum radius $r_m$ (FIG. 3) of lower segment screw member 260, i.e, the distance from central axis L to a lower segment screw member peak 260' of the treads of lower segment screw member 260. Thus, in this embodiment spacial interference between tab 244 and lower segment screw member 260 during assembly of handle 100 is not encountered.

In yet another embodiment, lower segment screw member 260 coupled to lower segment connector surface 114 includes a helical groove (not shown) indented within lower segment screw member 260. The helical groove is configured within lower segment screw member 260 such that the helical path followed by a tab 244 at assembly is contained within the helical groove. In this alternative manner, spacial interference between tab 144 and lower segment screw member 260 during segment assembly is avoided.

FIG. 5C is a close-up perspective view similar to FIG. 5A showing lower segment connector surface 114 and upper segment connector surface 122 at a second point of threaded engagement after the first point of engagement depicted in FIG. 5B but still before lower segment 102 and upper segment 104 are completely assembled as shown in FIG. 5A. Referring to FIGS. 3, 4, and 5C together, at this second point of engagement shown in FIG. 5C, tab 244 has axially advanced to clear lower segment screw member 260. Further, at this second point of engagement, cog contacting face 252 (FIG. 4) of tab 244 has just come into abutting contact with tab flexing face 232 of cog 226.

With further clockwise rotation beyond the second point of engagement shown in FIG. 5C, tab 244 compresses radially inward about tab hinge 246 in a direction toward central axis L. During this further rotation after the second point of engagement, the abutting contact between the flared-out, arced surface of cog contacting face 252 (FIG. 2) of tab 244 and the radially inward sloping flat surface of tab flexing face 232 of cog 226, cooperate to cause tab 244 to compress radially inward toward central axis L about tab hinge 246.

With yet further rotation to complete assembly as shown in FIG. 5A, cog contacting face 252 of tab 244 clears tab flexing face 232 of cog 226. More specifically, at this complete assembly point of rotation, cog locking face 256 of tab 244 clears tab locking face of 234 of cog 244 whereby abutting contact between cog contacting face 252 of tab 244 and tab flexing face 232 of cog 226 (FIG. 3) is terminated. At this point of complete assembly, tab hinge 246 again elastically returns tab 244 to its original uncompressed, radially flared configuration as shown in FIGS. 4 and 5A. Further, at complete assembly, loosening counter-clockwise engagement of lower segment 102 and upper segment 104 is precluded by the ratchet-like abutting contact of tab locking face 234 of cog 226 with cog locking face 256 of the, now elastically restored, radially flared tab 244.

Referring to FIG. 5A, at complete assembly tab hinge 246 has elastically returned tab 244 to its original uncompress, radially flared configuration. Additionally, lower segment connector element 124A and upper segment connector element 124B, together comprising handle connector structure 124, are configured such that bottoming periphery 276 of upper segment connector element 124B abuts against bottoming plate 278 of lower segment connector element 124A. Also, at the same complete assembly rotational point, tab hinge 246 elastically returns tab 244 to its original uncompressed, radially flared configuration. Thus, after complete assembly, further tightening clockwise engagement of lower segment 102 and upper segment 104 is precluded by the abutting contact of bottoming periphery 276 of upper segment connector element 124B against bottoming plate 278 of lower segment connector element 124A.

Thus, after complete assembly, the upper segment and lower segment screw members, and the respective segments to which they are coupled, may be neither further tightened nor loosened after complete assembly. Said another way, at full engagement, all relative rotation of the upper and lower segments about the longitudinal axis of the handle is precluded and the relative angular position of the segments is fixed. Accordingly, by providing a segment handle that locks coupled handle segments against relative rotational motion after assembly, the present invention assures that the handle segments do not loosen and any ergonomically designed shape of the handle is maintained during tool use.

The cooperation between post 228 and stop 248 during assembly of upper segment 102 and lower segment 104 of handle 100 is next described. FIG. 6A is a close-up perspective view similar to FIG. 2 showing, after complete assembly, lower segment connector surface 112 of lower segment 102 and upper segment connector surface 122 of upper segment 104. For clarity of presentation, in FIG. 6A, only the right part of lower segment 102 and the left part of upper segment 104 of handle 100 are shown, although it is understood that lower part of lower segment 102 and right part of upper segment 104 are fixedly joined to corresponding parts prior to initial assembly of lower segment 102 with upper segment 104.

Figure 6A:
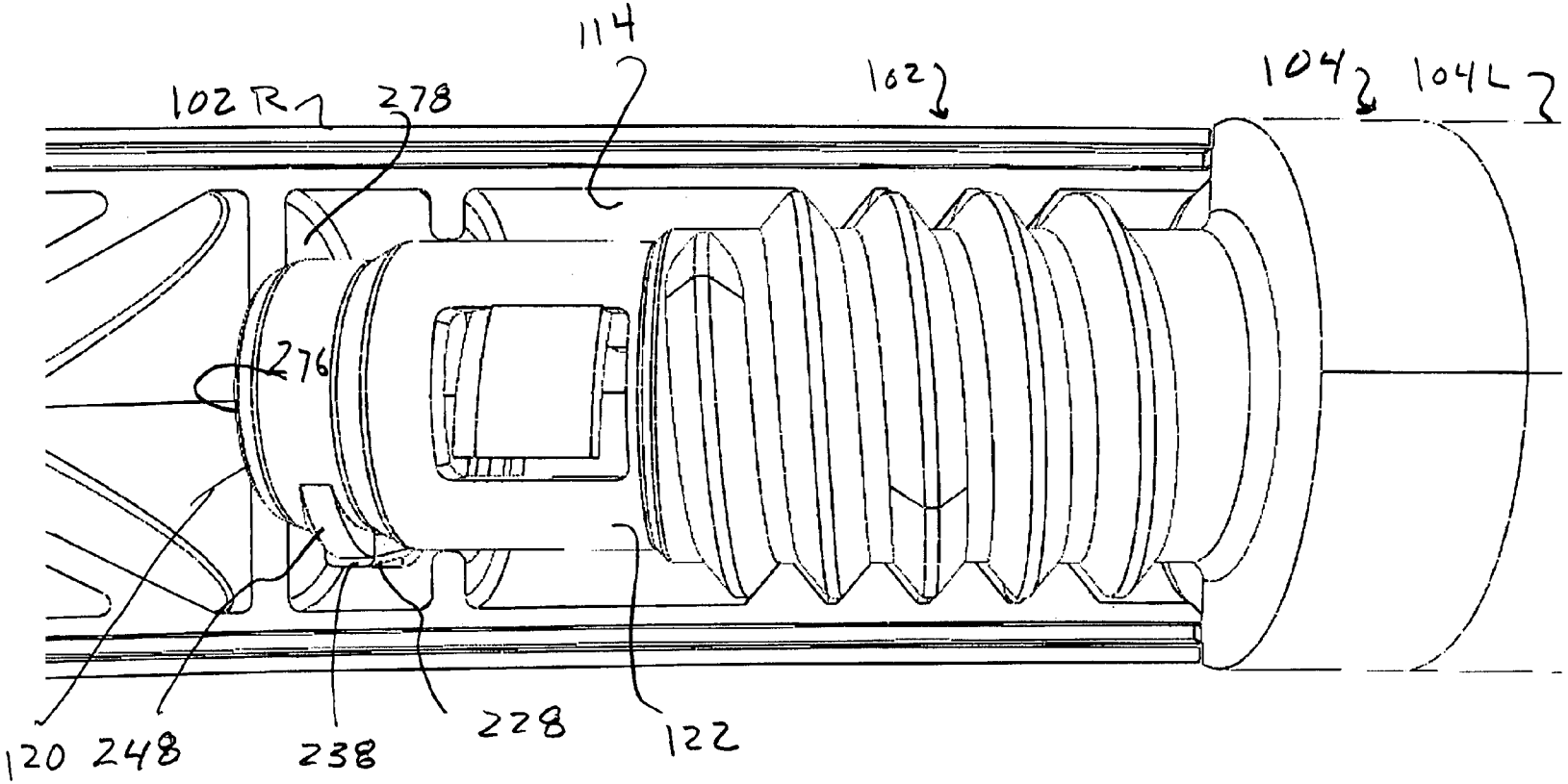
FIG. 6A is a close-up perspective view similar to FIG. 2 showing, after complete assembly, the lower segment connector surface of the lower segment right part and the upper segment connector surface of the upper segment left part.

Referring to FIGS. 3, 4, and 6A, at complete assembly of lower segment 102 and upper segment 104, stop locking face 238 of post 228 is positioned to engage post locking face 266 (FIG. 4) of stop 248 in abutting contact thereby precluding, loosening counter disengagement of lower segment 102 and upper segment 104. Also, as described above with reference to FIG. 5A, at completion of assembly, upper segment 104 has advanced within lower segment 102 to a point where bottoming periphery 276 adjacent upper segment connector end 120 contacts bottoming plate 278, coupled to lower segment connector surface 114, thereby precluding further clock-wise tightening engagement of lower segment 102 and upper segment 104.

Figure 6B:
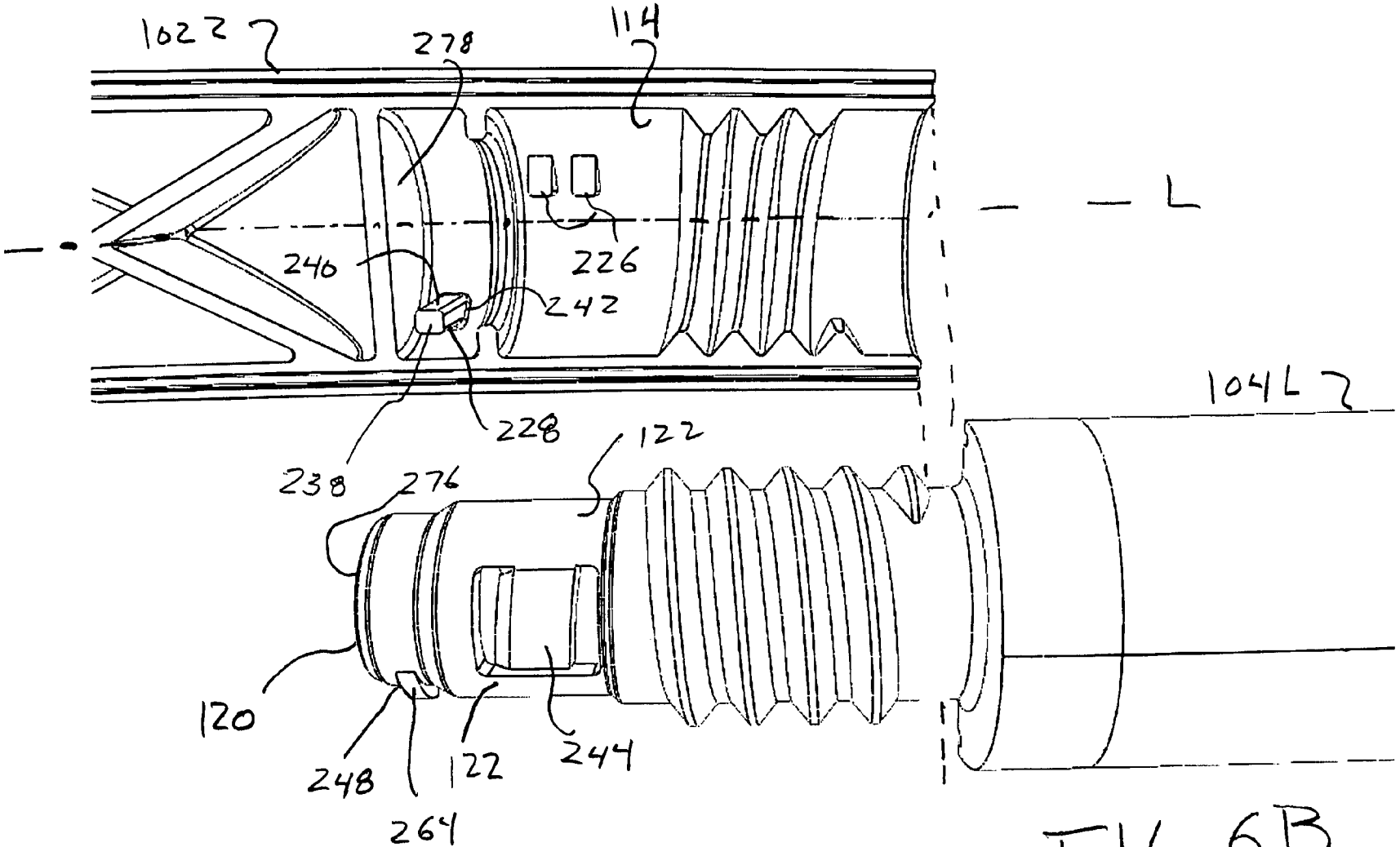
FIG. 6B is a close-up perspective view similar to FIG. 6A showing the lower segment connector surface and the upper segment connector surface at point of threaded engagement immediately before the lower segment and the and upper segment are completely assembled as shown in FIG. 6A.

More particularly, FIG. 6B is a close-up perspective view similar to FIG. 6A showing lower segment connector surface 114 and upper segment connector surface 122 at point of threaded engagement immediately before lower segment 102 and upper segment 104 are completely assembled as shown in FIG. 6A. For clarity of presentation in FIG. 6B, the right part of lower segment 102 and the left part of upper segment 104 of handle 100 are offset. At the point of engagement shown in FIG. 6B, stop contacting face 240 of post 228 has just come into abutting contact with post flexing face 264 of stop 248. With further clockwise rotation, post 228 flexes radially outward about post hinge 242 in a direction away from central axis L.

During this further rotation, the abutting contact between the flat surface of stop contacting face 240 of post 228 and the outwardly spiraling, sloping curved surface of post flexing face 264 of stop 248, cooperate to displace post 228 outwardly from central axis L. With yet further rotation to complete assembly as shown in FIG. 6A, stop 248 clears post 228. More specifically, at this complete assembly point of rotation, post locking face 266 (FIG. 4) of stop 248 clears stop locking face 238 of post 228, whereby abutting contact is terminated between stop contacting face 240 of post 228 and post flexing face 264 of stop 248. At this point of complete assembly, post 228 elastically returns inwardly toward central axis L to its original undeflected configuration as shown in FIG. 6A. Further, at complete assembly, loosening counter clockwise engagement of lower segment 102 and upper segment 104 is precluded by the ratchet-like abutting contact of post locking face 266 (FIG. 4) of stop 248 with stop locking face 238 of the now elastically restored, undeflected post 228.

Referring to FIG. 6A, at complete assembly post hinge 242 has elastically returned post 228 to its original undeflected configuration. Additionally, lower segment connector element 124A and upper segment connector element 124B, together comprising handle connector structure 124, are configured such that bottoming periphery 276 of upper segment connector element 124B abuts against bottoming plate 278 of lower segment connector element 124A at the same complete assembly rotational point that post hinge 242 elastically returns post 228 to its original undeflected configuration. Thus, after complete assembly, further tightening clock-wise engagement of lower segment 102 and upper segment 104 is precluded by the abutting contact of bottoming periphery 276 of upper segment connector element 124B against bottoming plate 278 of lower segment connector element 124A.

Thus, after complete assembly, the upper segment and lower segment screw members, and the respective segments to which they are coupled, may be neither further tightened nor loosened after complete assembly. Said another way, at full engagement, all relative rotation of the upper and lower segments about the central axis of the handle is precluded and the relative angular position of the segments is fixed. Accordingly, by providing a segment handle that locks coupled handle segments against relative rotational motion after assembly, the present invention assures that the handle segments do not loosen and that an ergonomically designed shape of the handle is maintained during use.

In another embodiment, cog 226, tab 244, post 228 and stop 248 are duplicated on corresponding left and right parts of lower segment 102 and upper segment 104 thereby providing additional locking against counter clock-wise loosening engagement of lower segment 102 and upper segment 104 after complete assembly. In addition, those of skill in the art will recognize that the configuration of landing components as wedge shaped cogs and stops and flexing components as flared out tabs and pillar-like posts may be varied without departing from the principles of the present invention.

Figure 8:
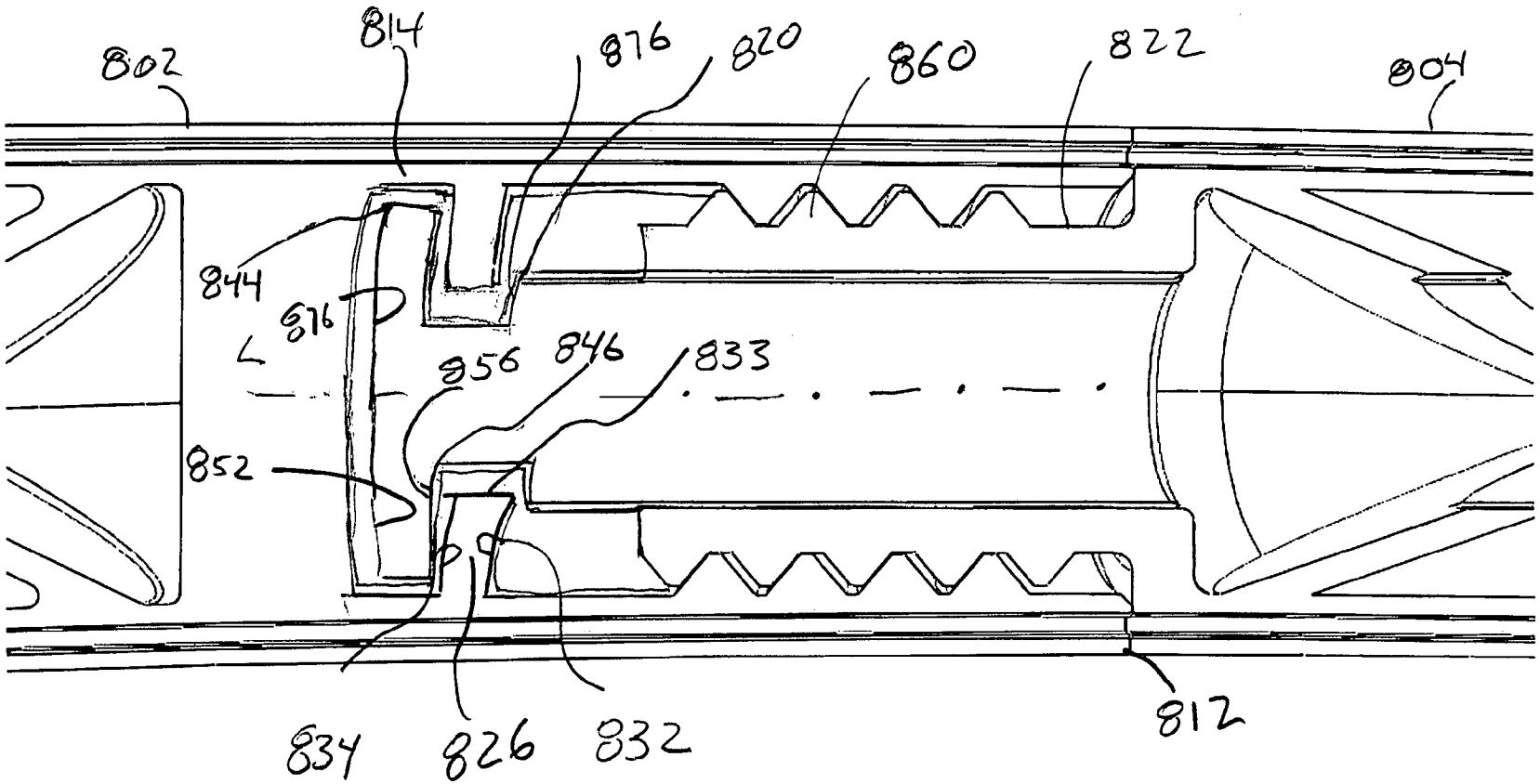
FIG. 8 is a close-up perspective view similar to FIG. 2 showing, after complete assembly, another embodiment of the lower segment connector surface of the lower segment right part and the upper segment connector surface of the upper segment right part.

In another example, FIG. 8 is a close-up perspective view similar to FIG. 2 showing, after complete assembly, another embodiment of a lower segment connector surface 814 of a lower segment 802 and an upper segment connector surface 822 of upper segment 804. In FIG. 8, only the segment right parts are shown. In this embodiment, at least one tab 844, configured generally as rectangular shaped block projecting in a direction outwardly from central axis L from a bottoming periphery 876 adjacent an upper segment connector end 820, is flexibly coupled to upper segment connector surface 822 by a tab hinge 846. Alternatively, tab 844 is configured as a continuous ring-like projection coupled to and circumscribing upper segment connector surface 822. A cog contacting face 852 of tab 844, located most proximal upper segment connector end 820 is configured as a chamfered surface slanting backwardly toward upper segment connector end 820 to a cog locking face 856 opposite cog contacting face 852.

Further, in this embodiment, a cog 826 configured generally as a ring of rectangular shaped cross section projecting inwardly toward central axis L, is rigidly coupled to a lower segment connector surface 814 of lower segment 802. Cog 826 includes a tab flexing face 832, most proximal lower segment connector end 812, a tab locking face 834 opposite tab flexing face 832, and a cog edge face 833 spanning tab flexing face 832 and tab locking face 834.

In a manner similar to that described with reference to FIG. 5B, during assembly of this embodiment, tab 844 is compressed inwardly toward central axis L by abutting contact between cog contacting face 852 of tab 844 and tab flexing face 832 of cog 826. The backward chamfer of cog contacting face 852, directs compression of tab 844 radially inward in a direction toward central axis L allowing cog contacting face 852 of tab 844 to ride up on cog edge face 833 to maintain compression of tab 844. With further tightening rotation, tab 844 axially advances to the point where tab 844 clears cog edge face 833, whereby tab hinge 846 elastically returns tab 844 to its original uncompressed, radially outwardly protruding configuration.

Figure 9:
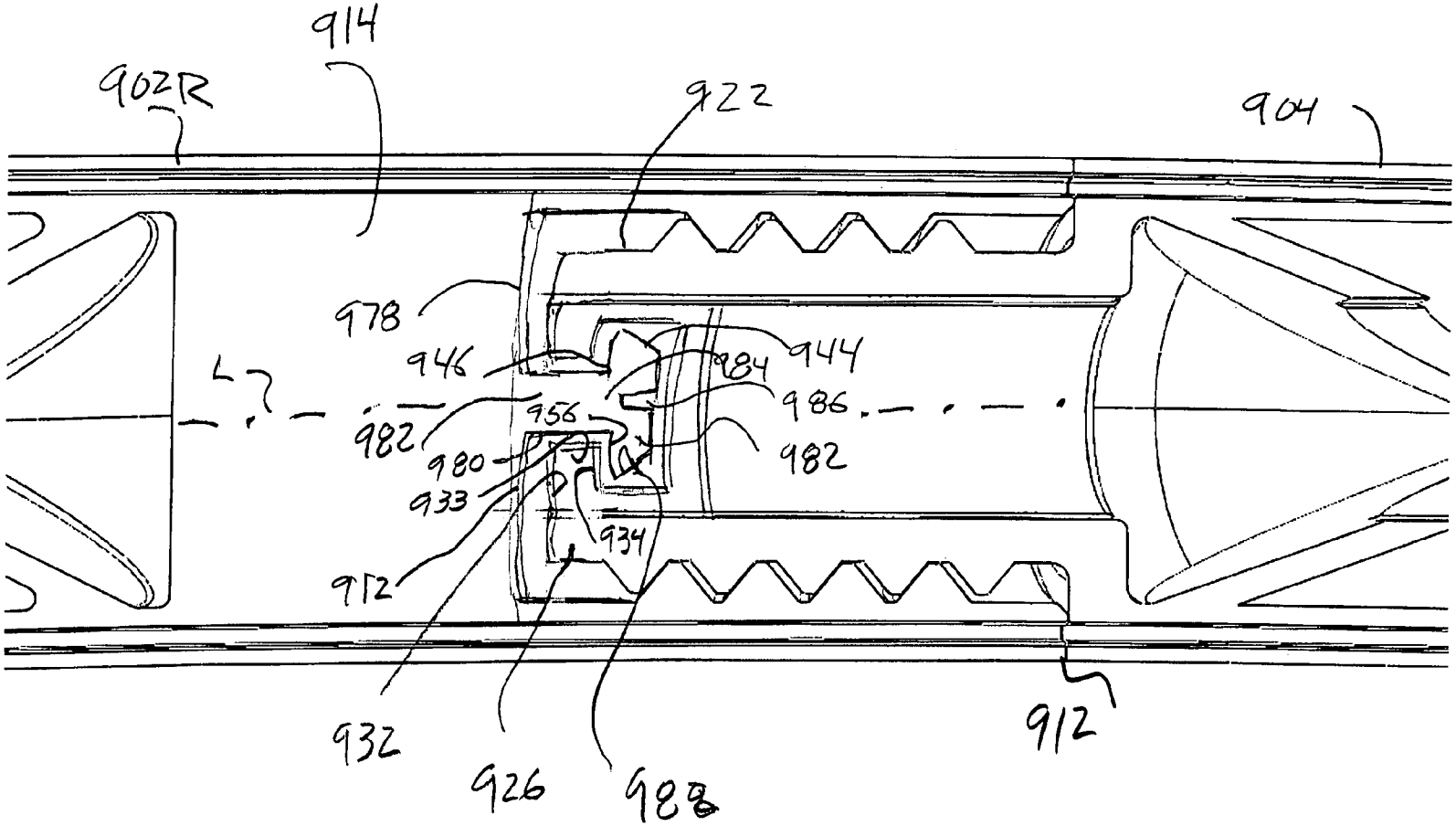
FIG. 9 is a close-up perspective view similar to FIG. 2 showing, after complete assembly, another embodiment of the lower segment connector surface of the lower segment right part and the upper segment connector surface of the upper segment right part.

In yet another example, FIG. 9 is a close-up perspective view similar to FIG. 2 showing, after complete assembly, another embodiment of a lower segment connector surface 914 of a lower segment 902 and an upper segment connector surface 922 of an upper segment 904. In FIG. 9, only the segment right parts are shown. In this embodiment, an upper segment flexing component is configured generally as a nubbed tab 944 projected from a bottoming plate 978 coupled to a lower segment connector surface 114. Tab 944 includes a shaft 980 couple at a coupling end 982 to a bottoming plate 978. A tab button 982 is coupled to a tab end 984 of shaft 980 opposite coupling end 982 of shaft 980. Tab button 982 is configured as a conical shaped solid having a central hollow indentation 986 at the conical point of tab button 982 that projects backwardly toward an upper segment connector end 912 of upper segment 904. Tab button 982 has a cog contacting face 988 that forms the conical surface of tab button 982 and a cog locking face 956 opposite cog contacting face 988.

Further, in this embodiment, a lower segment landing component, configured as a cog 926 generally shaped as a ring of rectangular shaped cross section projecting inwardly toward central axis L, is rigidly coupled to an upper segment connector surface 922 of upper segment 904. Cog 926 includes a tab flexing face 932, most distal lower segment connector end 912, a tab locking face 934 opposite tab flexing face 932, and a cog edge face 933 spanning tab flexing face 932 and tab locking face 934.

In a manner similar to that described with reference to FIG. 5*b*, during assembly of this embodiment, tab button 982 is compressed inwardly toward central axis L and indentation 986, by abutting contact between cog contacting face 952 of tab button 982 and tab flexing face 932 of cog 926. At the point of engagement where tab button 984 clears cog edge face 933, a tab hinge 946 elastically returns tab button 982 to its original uncompress configuration. At this point of complete assembly, tab locking face 934 of cog 926 locks against cog locking face 956 of tab button 984, thereby precluding loosening of lower segment 902 and upper segment 904.

Figure 10A:
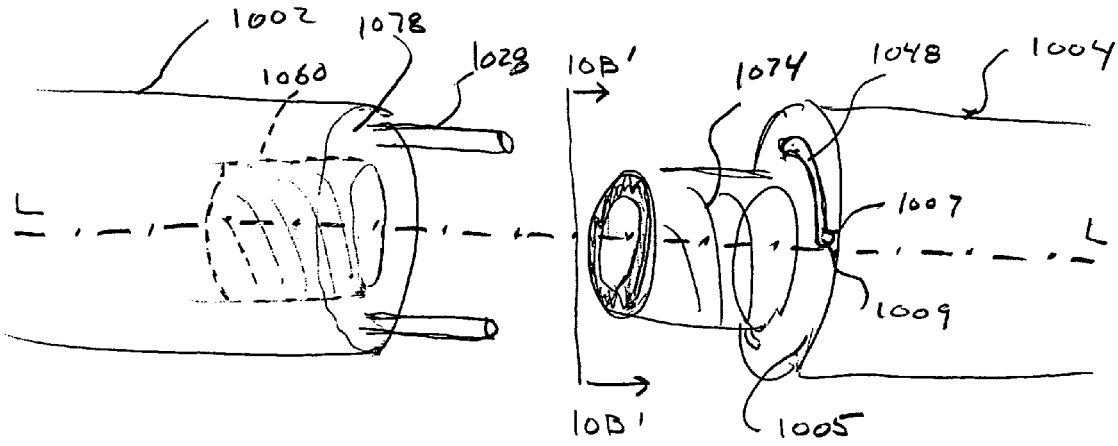
FIG. 10A is a close-up perspective showing, before assembly, another embodiment of the lower segment connector surface of the lower segment and the upper segment connector surface of the upper segment.
Figure 10B:
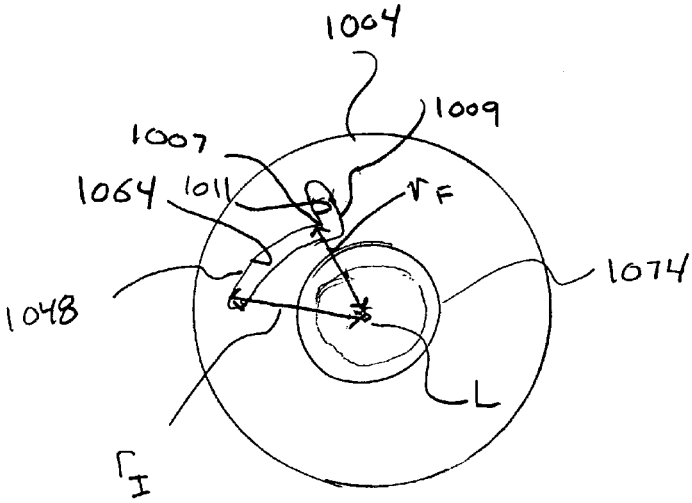
FIG. 10B is a close-up perspective end view taken in the direction of 10B' shown in FIG. 10A.

In yet another example of the locking segmented handle of the present invention, FIG. 10A is a close-up perspective showing, before assembly, an embodiment of a lower segment 1002 and an upper segment 1004. FIG. 10B is a close-up perspective end view of lower segment 1002 taken in the direction of 10B' shown in FIG. 10A. Referring to FIGS. 10A and 10B together, in this embodiment, a post 1028 is flexibly coupled to a bottoming periphery 1078 of lower segment 1002. Post 1028 is axially oriented in a direction generally parallel to a handle central axis L of the segmented handle of the present invention.

Further, in this embodiment, a stop 1048, configured generally as an indentation cut into an upper segment shoulder 1005 of upper segment 1004, is adjacent an upper segment screw member 1074 of upper segment 1004. As best seen in FIG. 10B, stop 1048 is shaped generally as a spiral having an initial radius $r_I$ as measured from central axis L to a post flexing face 1064 within the indentation groove of stop 1048. Stop 1048 has a final radius $r_F$, less than $r_I$, at a catch end 1007 of the spiral path of stop 1048. Stop 1048 further includes a catch portion 1009 adjacent catch end 1007. Catch portion 1009 of stop 1048 is an indented groove in upper segment shoulder 1005. Catch portion 1009 begins at stop end is generally directed radially outwardly away from central axis L at catch end 1007.

At assembly, upper segment screw member 1074 is engaged with a lower segment screw member 1060, shown in dotted line through lower segment 1002. At a particular point of assembly, post 1028 enters the indentation of stop 1048. With further tightening engagement, post 1028 is flexed inwardly toward central axis L as upper segment screw member 1074 and lower segment screw member 1060 are further engaged in a tightening direction. During this further tightening engagement, post flexing face 1064 abutingly contacts post 1028 to compress post in a radial direction toward central axis L. At complete assembly, post 1028 clears post flexing face 1064 of stop 1048 and encounters the indentation of catch portion 1009 of stop 1048. At this point, post 1028 elastically returns to its original uncompressed configuration and locks against a post locking face 1011 of catch portion 1009. In this manner, loosening threaded disengagement of lower segment 1002 and upper segment 1004 is precluded.

Figure 7A:
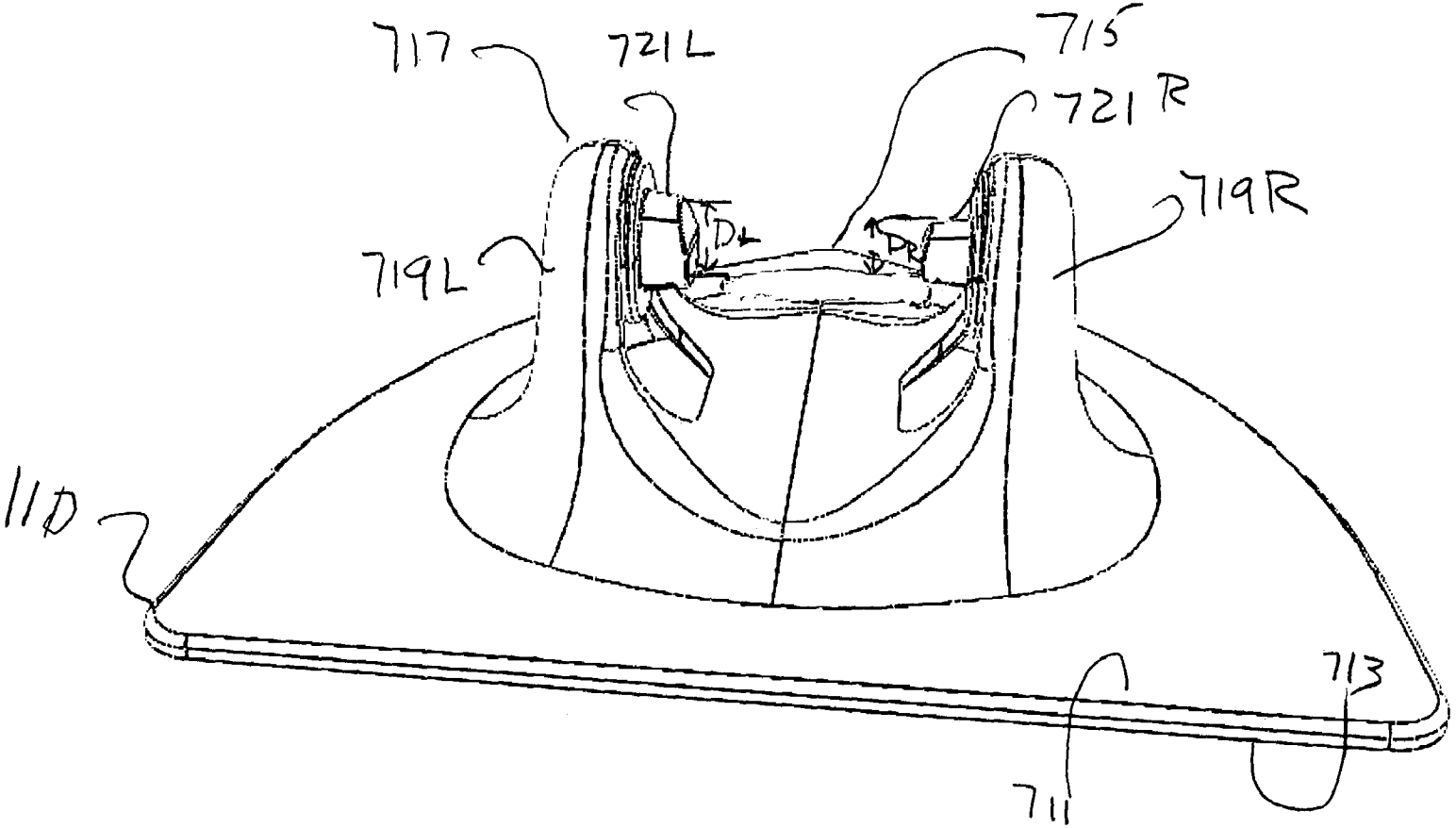
FIG. 7A is a close-up perspective view of the cleaning head of the cleaning implement of FIG. 1A as seen from the handle.

The attachment of cleaning head 110 to head end surface 108 of lower segment 102 is next described. FIG. 7A is a close-up perspective view of cleaning head 110 of cleaning implement 10 of FIG. 1A as seen from handle 100. Referring to FIG. 7A, in one embodiment, cleaning head 110 is configured as flat plate having a top surface 711 most proximal handle 100 (FIG. 1A), and a cleaning head bottom surface 713 opposite top surface 711. Cleaning head 110 is flexible and tapers to a point 715 in the manner of a clothes iron head. In another embodiment, cleaning head 110 is generally round. Also, other configurations of cleaning head 110 are also possible without departing from the principles of the present invention. A dry, wet or wettable sheet or pad (not shown) is attached to cleaning head bottom surface 713.

In use of cleaning implement 10 of FIG. 1A, the sheet is placed in contact with a hard surface, such as a wood floor or a tile fixture or stall, to scrub and clean. In this embodiment, the flexible characteristic of cleaning head 110 allows cleaning head 110 to conform to a curved hard surface, such as a tub or shower stall, to provide contact between the sheet or pad and the curved hard surface. Further, point 715 of cleaning head 110 provides for cleaning of tight corners or points.

Cleaning head 110, further includes a "U" shaped yoke 717 coupled to top surface 711 of cleaning head 110 at the bottom of its "U" shape. The "U" shape yoke 717 is completed by a cleaning head right arm 719R adjacent lower segment right part 102R (FIG. 1C) and a cleaning head left arm 719L adjacent lower segment left part 102L (FIG. 1C), both generally configured as a broadly based post. Coupled adjacent the top of cleaning head right arm 719R is a right arm boss 721R. Right arm boss 721R is configured generally as a uniform shaft, parallel along its longitudinal axis to cleaning head 110 and directed toward left arm boss 721L. Coupled adjacent the top of cleaning head left arm 719L is a left arm boss 721L. Left arm boss 721L is likewise configured generally as a uniform shaft, parallel along its longitudinal axis to cleaning head 110 and directed toward right arm boss 721R. In one embodiment the length of a right arm boss diameter DR of right arm boss 721R is less than the length of a left arm boss diameter DL of left arm boss 721L. Right arm boss 721R and left arm boss 721L are configured to cooperate with corresponding components on lower segment right part 102R and lower segment left part 102L (FIG. 1C) to rotatably couple cleaning head 110 to handle 100 (FIG. 1A).

Figure 7B:
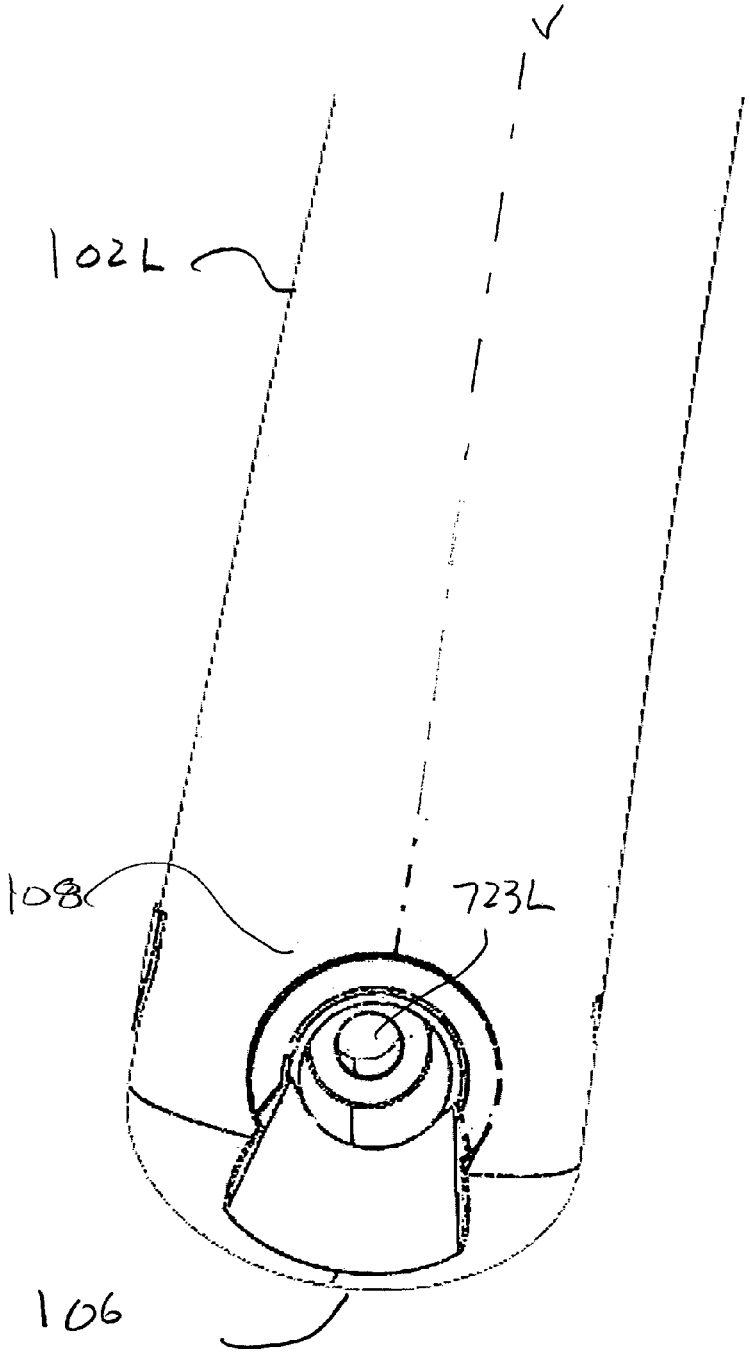
FIG. 7B is a close-up perspective view of the head end surface adjacent to the head end of the lower segment left part.

FIG. 7B is a close-up perspective view of head end surface 108 adjacent to head end 106 of lower segment left part 102L. Referring to FIG. 7B, head end surface 108 of lower segment left part 102L defines a left arm boss receptacle 723L configured as circular aperture in the left part of head end surface 108. Left arm boss receptacle 723 is configured to receive left arm boss 721L of cleaning head 110 (FIG. 7A) and to reject right arm boss 721R of cleaning head 110 (FIG. 7A). In a similar manner, head end surface 108 of lower segment right part 102R (FIG. 1C, only lower segment left part 102L is shown in FIG. 7B), defines a right arm boss receptacle (not shown) configured as a circular aperture in the right part of head end surface 108. The right arm boss receptacle is configured to receive right arm boss 721R of cleaning head 110 (FIG. 7A) and to reject left arm boss 721L of cleaning head 110 (FIG. 7A).

Thus left arm boss 721L cooperates with left arm boss receptacle 723L and right arm boss 721R cooperates with right arm boss receptacle (not shown) to allow cleaning head 110 to rotate about the longitudinal axes of left arm boss 721L and right arm boss 721R. Further, by this arrangement cleaning head 110 may be coupled to handle 100 in only one direction with point 715 placed most distal to handle 100.

In one embodiment, left arm boss receptacle 723L tapers inwardly thereby defining a left arm boss receptacle draft angle (not shown). Likewise, right arm boss receptacle 723R tapers inwardly thereby defining a right arm boss receptacle draft angle (not shown). Further, in this embodiment, left arm boss 721L and right arm boss 721R (FIG. 7A) are generally configured as tapered shafts. Thus, the length of a left arm boss diameter $D_L$ and right arm boss diameter $D_R$ (FIG. 7A) are not constants and thereby define a left arm boss draft angle (not shown) and a right arm boss draft angle (not shown), respectively. Further, the left arm boss draft angle is somewhat greater than the left arm boss receptacle draft angle. Thus, left arm boss 721L (FIG. 7A) and left arm boss receptacle 723L (FIG. 7B) may be configured such that they abuttingly contact and generate a frictional force when left arm boss 721L attempts to rotates within left arm boss receptacle 723L. By this frictional force, head 110 may be set to maintain a specific rotational orientation relative to handle 100 (FIG. 1B) during use of cleaning implement 10. Right arm boss 721R (FIG. 7A) and right arm boss receptacle (not shown) may be similarly configured to provide additional frictional force to maintain the rotational orientation of head 110 and handle 100 during use of cleaning implement 10.

The embodiments herein are illustrated in the context of a two segment handle for use with a cleaning implement. The skilled artisan will readily appreciate, however, that the structures disclosed have application in a number of other contexts where a locking segmented handle is desirable, or where maintenance of an ergonomic design is important.

For example, the locking segmented handle of the present invention is not limited to a two segment handle. One or more intermediate segments having intermediate segment first connector elements comprising lower segment connector components, as described above, on one end and a cooperating intermediate segment second connector comprising upper segment connector components, as also described above, on an opposite end, may be lockably assembled together between the lower and upper segments of the handle. The intermediate segments are threadibly engageable and, at complete assembly, two or more intermediate segments are coupled and locked in the manner described above with reference to the lower segment and the upper segment. The lower segment and upper segment are each also threadible engageable with the intermediate segments. At complete assembly of a lower segment and an upper segment with an intermediate segment, the upper segment and lower segment are coupled and locked with the intermediate segment in the manner describe above.

In addition, those of skilled in the art will recognize that connector components described as being located on the lower segment may be configured such that those connector components may be located on the upper segment. Likewise, a skilled artisan will readily appreciate, that connector components described as being located on the upper segment may be configured such that those connector components may be located on the lower segment.

Finally, this invention has been described herein in considerable detail to provide those skilled in the art with information relevant to apply the novel principles and to construct and use such specialized components as are required. However, it is to be understood that the invention can be carried out by different components, materials and devices, and that various modifications can be accomplished without departing from the scope of the invention itself.

We claim:

1. A segmented handle comprising:

a first segment having a first segment connector end and a first segment connector surface adjacent said first segment connector end;

a first segment screw member coupled to said first segment connector surface;

at least one first segment landing component coupled to said first segment connector surface;

a bottoming plate coupled to said first segment connector surface;

a second segment having a second segment connector end and a second segment connector surface adjacent said second segment connector end;

a second segment screw member coupled to said second segment connector surface, wherein said second segment screw member is threadibly engageable with said first segment screw member;

at least one second segment flexing component coupled to said second segment connector surface;

a bottoming periphery adjacent to said second segment connector end;

wherein, at complete threaded engagement of said first segment screw member and said second segment screw member, said at least one second segment flexing component contacts and cooperates with a corresponding one of said at least one first segment landing component, and said bottoming plate contacts and cooperates with said bottoming periphery, to lock said first segment and said second segment against relative rotational motion.

2. The segmented handle of claim 1 wherein said at least one first segment landing component comprises a cog rigidly coupled to said first segment connector surface, said cog being generally configured as a wedge shaped block;

wherein said at least one second segment flexing component comprises at least one tab flexibly coupled to and flaring outwardly from said second segment connector surface, said at least one tab being generally configured as a rectangular shaped plate, arced in one plane;

wherein, at complete threaded engagement of said first segment screw member and said second segment screw member, said at least one tab contacts and cooperates with a corresponding one of said at least one cog to lock said first segment and said second segment against loosening threadible disengagement; and wherein, at complete threaded engagement of said first segment screw member and said second segment screw member, said bottoming plate contacts and cooperates with said bottoming periphery, to lock said first segment and said second segment against tightening threadible engagement.

3. The segmented handle of claim 1 wherein said at least one first segment landing component comprises a cog, said cog being generally configured as an indentation within said first segment surface;

wherein said at least one second segment flexing component comprises a tab flexibly coupled to and flaring outwardly from said second segment connector surface, said tab being generally configured as a rectangular shaped plate, arced in one plane;

wherein, at complete threaded engagement of said first segment screw member and said second segment screw member, said at least one tab contacts and cooperates with a corresponding one of said at least one cog to lock said first segment and said second segment against loosening threadible disengagement; and wherein, at complete threaded engagement of said first segment screw member and said second segment screw member, said bottoming plate contacts and cooperates with said bottoming periphery, to lock said first segment and said second segment against tightening threadible engagement.

4. The segmented handle of claim 1 wherein said at least one first segment landing component comprises a cog rigidly coupled to said first segment surface, said cog being generally configured as a ring projecting inwardly toward a central axis of said handle;

wherein said at least one second segment flexing component comprises a tab flexibly coupled to said second segment connector surface, said tab being generally configured as a block projecting outwardly from said central axis of said handle;

wherein, at complete threaded engagement of said first segment screw member and said second segment screw member, said at least one tab contacts and cooperates with a corresponding one of said at least one cog to lock said first segment and said second segment against loosening threadible disengagement; and wherein, at complete threaded engagement of said first segment screw member and said second segment screw member, said bottoming plate contacts and cooperates with said bottoming periphery, to lock said first segment and said second segment against tightening threadible engagement.

5. The segmented handle of claim 1 wherein said at least one first segment landing component comprises a cog rigidly coupled to said first segment surface, said cog being generally configured as a ring projecting inwardly toward a central axis of said handle; and wherein said at least one flexing component comprises a nubbed tab having a tab button, said nubbed tab being flexibly coupled to said second segment connector surface, said tab button being generally configured as conical solid having a central hollow indentation at the conical point of said nubbed tab; and wherein, at complete threaded engagement of said first segment screw member and said second segment screw member, said at least one tab button contacts and cooperates with a corresponding one of said at least one cog to lock said first segment and said second segment against loosening threadible disengagement; and wherein, at complete threaded engagement of said first segment screw member and said second segment screw member, said bottoming plate contacts and cooperates with said bottoming periphery, to lock said first segment and said second segment against tightening threadible engagement.

6. The segmented handle of claim 1 wherein said first segment is integrally formed and wherein said second segment is integrally formed.

7. The segmented handle of claim 1 wherein said first segment is formed in parts and wherein said second segment is formed in parts.

8. A segmented handle comprising:

a first segment having a first segment connector end and a first segment connector surface adjacent said first segment connector end;

a first segment screw member coupled to said first segment connector surface;

at least one first segment flexing component coupled to said first segment connector surface;

a bottoming plate coupled to said first segment connector surface;

a second segment having a second segment connector end and a second segment connector surface adjacent said second segment connector end;

a second segment screw member coupled to said second segment connector surface, wherein said second segment screw member is threadibly engageable with said first segment screw member;

at least one second segment landing component coupled to said second segment connector surface;

a bottoming periphery adjacent to said second segment connector end; and wherein, at complete threaded engagement of said first segment screw member and said second segment screw member, said at least one first segment flexing component contacts and cooperates with a corresponding one of said at least one second segment landing component, and said bottoming plate contacts and cooperates with said bottoming periphery, to lock said first segment and said second segment against relative rotational motion.

9. The segmented handle of claim 8 wherein said at least one first segment flexing component comprises a post flexibly coupled to said first segment connector surface, said post being generally configured as a pillar, wherein said at least one second segment landing component comprises a stop rigidly coupled to said second segment connector surface, said stop being generally configured as a wedge shaped block;

wherein, at complete threaded engagement of said first segment screw member and said second segment screw member, said at least one post contacts and cooperates with a corresponding one of said at least one stop to lock said first segment and said second segment against loosening threadible disengagement; and wherein, at complete threaded engagement of said first segment screw member and said second segment screw member, said bottoming plate contacts and cooperates with said bottoming periphery, to lock said first segment and said second segment against tightening threadible engagement.

10. The segmented handle of claim 8 further comprising:

at least one first segment landing component coupled to said first segment connector surface;

at least one second segment flexing component coupled to said first segment connector surface;

wherein, at complete threaded engagement of said first segment screw member and said second segment screw member, said at least one first segment flexing component contacts and cooperates with a corresponding one of said at least one second segment landing component to lock said first segment and said second segment against loosening threadible disengagement; and wherein, at complete threaded engagement of said first segment screw member and said second segment screw member, said bottoming plate contacts and cooperates with said bottoming periphery, to lock said first segment and said second segment against tightening threadible engagement.

11. The segmented handle of claim 10 wherein said at least one first segment landing component comprises a cog rigidly coupled to said first segment connector surface; said cog being generally configured as a wedge shaped block;

wherein said at least one second segment flexing component comprises a tab flexibly coupled to and flaring outwardly from said second segment connector surface, said at least one tab being generally configured as a rectangular shaped plate, arced in one plane; and wherein, at complete threaded engagement of said first segment screw member and said second segment screw member, said at least one tab contacts and cooperates with a corresponding one of said at least one cog to lock said first segment and said second segment against loosening threadible disengagement.

12. The segmented handle of claim 10 wherein said at least one first segment landing component comprises a cog, said cog being generally configured as an indentation within said first segment surface;

wherein said at least one second segment flexing component comprises a tab flexibly coupled to and flaring outwardly from said second segment surface, said tab being generally configured as a rectangular shaped plate, arced in one plane; and wherein, at complete threaded engagement of said first segment screw member and said second segment screw member, said at least one tab contacts and cooperates with a corresponding one of said at least one cog to lock said first segment and said second segment against loosening threadible disengagement.

13. The segmented handle of claim 10 wherein said at least one first segment landing component comprises a cog rigidly coupled to said first segment surface, said cog being generally configured as a ring projecting inwardly toward a central axis of said handle;

wherein said at least one second segment flexing component comprises a tab flexibly coupled to said second segment surface, said tab being generally configured as a block projecting outwardly from said central axis of said handle;

wherein, at complete threaded engagement of said first segment screw member and said second segment screw member, said at least one tab contacts and cooperates with a corresponding one of said at least one cog to lock said first segment and said second segment against loosening threadible disengagement.

14. The segmented handle of claim 10 wherein said at least one first segment landing component comprises a cog rigidly coupled to said first segment surface, said cog being generally configured as a ring projecting inwardly toward a central axis of said handle; and wherein said at least one flexing component comprises a nubbed tab having a tab button, said nubbed tab being flexibly coupled to said second segment surface, said tab button being generally configured as conical solid having a central hollow indentation at the conical point of said nubbed tab; and wherein, at complete threaded engagement of said first segment screw member and said second segment screw member, said tab button contacts and cooperates with a corresponding one of said at least one cog to lock said first segment and said second segment against loosening threadible disengagement.

15. A segmented handle comprising:

a first segment having a first segment connector element;

a second segment having a second segment connector element, said second segment being threadibly engageable with said first segment;

wherein, at complete threaded engagement of said first segment and said second segment, said first segment connector element cooperates with said second segment connector element to lock said first segment and said second segment against relative rotational motion;

wherein said first segment connector element comprises at least one first segment landing component and wherein said second segment connector element comprises at least one second segment flexing component;

wherein, at complete threaded engagement of said first segment and said second segment, said at least one first segment landing component contacts and cooperates with a corresponding one of said at least one second segment flexing component to lock said first segment and said second segment against loosening threadible disengagement;

wherein said at least one first segment landing component comprises a cog rigidly coupled to said first segment, said cog being generally configured as a wedge shaped block;

wherein said at least one second segment flexing component comprises a tab flexibly coupled to and flaring outwardly from said second segment, said at least one tab being generally configured as a rectangular shaped plate, arced in one plane; and wherein, at complete threaded engagement of said first segment and said second segment, said at least one cog contacts and cooperates with a corresponding one of said at least one tab to lock said first segment and said second segment against loosening threadible disengagement.

16. The segmented handle of claim 15 wherein said at least one first segment landing component comprises a cog, said cog being generally configured as an indentation within said first segment; and wherein said at least one second segment flexing component comprises a tab flexibly coupled to and flaring outwardly from said second segment, said tab being generally configured as a rectangular shaped plate, arced in one plane.

17. The segmented handle of claim 15 wherein said at least one first segment landing component comprises a cog rigidly coupled to said first segment, said cog being generally configured as a ring projecting inwardly toward a central axis of said handle; and wherein said at least one second segment flexing component comprises a tab flexibly coupled to said second segment, said tab being generally configured as a block projecting outwardly from said central axis of said handle.

18. The segmented handle of claim 15 wherein said at least one first segment landing component comprises a cog rigidly coupled to said first segment, said cog being generally configured as a ring projecting inwardly toward a central axis of said handle; and wherein said at least one second segment flexing component comprises a nubbed tab having a tab button, said nubbed tab being flexibly coupled to said second segment, said tab button being generally configured as conical solid having a central hollow indentation at the conical point of said nubbed tab.

19. A segmented handle comprising:

a first segment having a first segment connector element;

a second segment having a second segment connector element, said second segment being threadibly engageable with said first segment;

wherein, at complete threaded engagement of said first segment and said second segment, said first segment connector element cooperates with said second segment connector element to lock said first segment and said second segment against relative rotational motion;

wherein said first segment connector element comprises at least one first segment flexing component;

wherein said second segment connector element comprises at least one second segment landing component;

wherein said first segment connector element comprises at least one first segment landing component;

wherein said second segment connector element comprises at least one second segment flexing component; and wherein, at complete threaded engagement of said first segment and said second segment, said at least one first segment landing component contacts and cooperates with a corresponding one of said at least one second segment flexing component to lock said first segment and said second segment against loosening threadible disengagement.

20. The segmented handle of claim 19 wherein said at least one second segment flexing component comprises a post flexibly coupled to said first segment, said post being generally configured as a rectangular pillar; and wherein said at least one second segment landing component comprises a stop rigidly coupled to said second segment, said stop being generally configured as a wedge shaped block.

21. A segmented handle comprising:

a first segment having a first segment connector element;

a second segment having a second segment connector element said second segment being threadibly engageable with said first segment;

wherein, at complete threaded engagement of said first segment and said second segment, said first segment connector element cooperates with said second segment connector element to lock said first segment and said second segment against relative rotational motion;

wherein said first segment connector element comprises at least one first segment landing component;

wherein said second segment connector element comprises at least one second segment flexing component;

wherein said first segment connector element comprises at least one first segment flexing component;

wherein said second segment connector element comprises at least one second segment landing component;

wherein, at complete threaded engagement of said first segment and said second segment, said at least one first segment landing component contacts and cooperates with a corresponding one of said at least one second segment flexing component to lock said first segment and said second segment against loosening threadible disengagement.

22. The segmented handle of claim 21 wherein said at least one first segment landing component comprises a cog rigidly coupled to said first segment, said cog being generally configured as a wedge shaped block;

wherein said at least one first segment flexing component comprises a post flexibly coupled to said first segment, said post being generally configured as a rectangular pillar, wherein said at least one second segment flexing component comprises a tab flexibly coupled to and flaring outwardly from said second segment, said tab being generally configured as a rectangular shaped plate, arced in one plane; and wherein said at least one second segment landing component comprises a stop rigidly coupled to said second segment, said stop being generally configured as a wedge shaped block.

23. The segmented handle of claim 21 wherein said at least one first segment landing component comprises a cog rigidly coupled to said first segment, said cog being generally configured as an indentation within said first segment;

wherein said at least one first segment flexing component comprises a post flexibly coupled to said first segment, said post being generally configured as a rectangular pillar;

wherein said at least one second segment flexing component comprises a tab flexibly coupled to and flaring outwardly from said second segment, said tab being generally configured as a rectangular shaped plate, arced in one plane; and wherein said at least one second segment landing component comprises a stop rigidly coupled to said second segment, said stop being generally configured as a wedge shaped block.

24. The segmented handle of claim 21 wherein said at least one first segment landing component comprises a cog rigidly coupled to said first segment, said cog being generally configured as a ring projecting inwardly toward a central axis of said handle;

wherein said at least one first segment flexing component comprises a post flexibly coupled to said first segment, said post being generally configured as a rectangular pillar;

wherein said at least one second segment flexing component comprises a tab flexibly coupled to and flaring outwardly from said second segment, said tab being generally configured as a block projecting outwardly from said central axis of said handle; and wherein said at least one second segment landing component comprises a stop rigidly coupled to said second segment, said stop being generally configured as a wedge shaped block.

25. The segmented handle of claim 21 wherein said at least one first segment landing component comprises a cog rigidly coupled to said first segment, said cog being generally configured as a wedge shaped block;

wherein said at least one first segment flexing component comprises a post flexibly coupled to said first segment, said post being generally configured as a rectangular pillar;

wherein said at least one second segment flexing component comprises a tab flexibly coupled to and flaring outwardly from said second segment, said tab being generally configured as a rectangular shaped plate, arced in one plane; and wherein said at least one second segment landing component comprises a stop rigidly coupled to said second segment, said stop being generally configured as a wedge shaped block.

26. A segmented handle comprising:

a first segment having a first segment connector element;

a second segment having a second segment connector element;

one or more intermediate segments wherein said intermediate segments have an intermediate segment first connector element and an intermediate segment second connector element opposite said intermediate segment first connector element;

wherein said intermediate segment first connector element is threadibly engageable with said first segment connector element;

wherein said intermediate segment second connector element is threadibly engageable with said second segment connector element;

wherein said intermediate segment first connecter element of one intermediate segment of the one or more intermediate segments is threadibly engageable with said intermediate segment second connector element of another intermediate segment of the one or more intermediate segments;

wherein, at complete threaded engagement of said first segment and said one intermediate segment, said first segment connector element cooperates with said intermediate segment first connector element of said one intermediate segment to lock said first segment and said one intermediate segment against relative rotational motion;

wherein, at complete threaded engagement of said second segment and said one intermediate segment, said second segment connector element cooperates with said intermediate segment second connector element of said one intermediate element to lock said second segment and said one intermediate segment against relative rotational motion; and wherein, at complete threaded engagement of said one intermediate segment and said another intermediate segment, said intermediate segment first connector element of said one intermediate segment cooperates with said intermediate segment second connector element of said another intermediate segment to lock said one intermediate segment and said another intermediate segment against relative rotational motion.

* * * * *